US009428943B2

(12) United States Patent
Mitchell et al.

(10) Patent No.: US 9,428,943 B2
(45) Date of Patent: Aug. 30, 2016

(54) MODULAR LATCH

(75) Inventors: Scott J. R. Mitchell, Woodbridge, CA (US); Jagdeep Playia, Brampton, CA (US); Chuan Liang, Scarborough, CA (US); Dani Androas, North York, CA (US); Dikran Ghorghorian, Scarborough, CA (US); Ilya Neyman, Thornhill, CA (US); Ioan D. Ilea, Vaughan, CA (US); John G. Zeabari, Highland, MI (US); Eduard Vasilescu, Newmarket, CA (US)

(73) Assignee: Magna Closures Inc., Newmarket (CA)

( * ) Notice: Subject to any disclaimer, the term of this patent is extended or adjusted under 35 U.S.C. 154(b) by 1251 days.

(21) Appl. No.: 12/528,637

(22) PCT Filed: Feb. 28, 2008

(86) PCT No.: PCT/CA2008/000380

§ 371 (c)(1),
(2), (4) Date: Aug. 26, 2009

(87) PCT Pub. No.: WO2008/104073

PCT Pub. Date: Sep. 4, 2008

(65) Prior Publication Data

US 2010/0117379 A1 May 13, 2010

Related U.S. Application Data

(60) Provisional application No. 60/892,031, filed on Feb. 28, 2007.

(51) Int. Cl.
*E05C 3/06* (2006.01)
*E05B 81/06* (2014.01)
(Continued)

(52) U.S. Cl.
CPC ..... *E05B 81/06* (2013.01); *E05B 77/06* (2013.01); *E05B 81/14* (2013.01); *E05B 81/20* (2013.01);
(Continued)

(58) Field of Classification Search
USPC ..... 292/201, 216, 221, DIG. 23
See application file for complete search history.

(56) References Cited

U.S. PATENT DOCUMENTS 4,664,430 A * 5/1987 Bernard ..... 292/201
4,735,447 A 4/1988 Kleefeldt
(Continued)

FOREIGN PATENT DOCUMENTS

EP 0038226 A1 10/1981

OTHER PUBLICATIONS

EP 08714701 Supplementary European Search Report dated Dec. 12, 2012.

*Primary Examiner* — Calos Lugo
(74) *Attorney, Agent, or Firm* — Grant Tisdall; Gowling Lafleur Henderson LLP

(57) ABSTRACT

A modular latch for an automotive vehicle is provided. It includes a latch core (a housing and a ratchet and pawl rotatably mounted to the housing), a mounting plate that secures the latch core to the vehicle. The latch cure can use any of a plurality of different mounting plates for a lift gate latch, a decklid latch, and a sliding door latch; A latch module is mounted to the latch core to provide different functional including a manual release latch module, a power release latch module, a power lock and unlock latch module, and a power cinching and release latch module. The latch cure may fit a more or less universal envelope. The latch may employ one or more status sensors. Those status sensors may sense striker position, and may not necessarily include any sensors mounted to monitor ratchet position. The latch may include a layered latch core in which one or more sensor members move in different planes from the pawl and ratchet.

3 Claims, 32 Drawing Sheets

(51) Int. Cl.

| | |
|---|---|
| ***E05B 77/06*** | (2014.01) |
| ***E05B 81/14*** | (2014.01) |
| ***E05B 81/20*** | (2014.01) |
| ***E05B 81/64*** | (2014.01) |
| ***E05B 85/02*** | (2014.01) |
| ***E05B 85/26*** | (2014.01) |
| ***E05B 81/36*** | (2014.01) |
| *E05C 3/00* | (2006.01) |
| *E05B 63/00* | (2006.01) |
| *E05B 81/68* | (2014.01) |
| *E05B 81/90* | (2014.01) |

(52) U.S. Cl.

CPC ..... *E05B 81/36* (2013.01); *E05B 81/64* (2013.01); *E05B 85/02* (2013.01); *E05B 85/26* (2013.01); *E05B 63/0056* (2013.01); *E05B 81/15* (2013.01); *E05B 81/68* (2013.01); *E05B 81/90* (2013.01); *Y10T 292/1047* (2015.04); *Y10T 292/1082* (2015.04)

(56) References Cited

U.S. PATENT DOCUMENTS

| | | | | |
|---|---|---|---|---|
| 4,762,348 | A * | 8/1988 | Matsumoto | 292/201 |
| 4,848,809 | A * | 7/1989 | Escaravage | 292/11 |
| 4,869,536 | A * | 9/1989 | Kleefeldt | 292/210 |
| 4,885,954 | A | 12/1989 | Wanlass | |
| 4,929,007 | A | 5/1990 | Bartczak et al. | |
| 4,962,955 | A | 10/1990 | Ferrara et al. | |
| 5,150,933 | A * | 9/1992 | Myslicki et al. | 292/216 |
| 5,516,164 | A * | 5/1996 | Kobayashi | 292/201 |
| 5,603,539 | A | 2/1997 | Gruhn et al. | |
| 5,639,130 | A * | 6/1997 | Rogers et al. | 292/216 |
| 5,938,252 | A * | 8/1999 | Uemura et al. | 292/201 |
| 6,256,932 | B1 * | 7/2001 | Jyawook et al. | 49/503 |
| 6,321,488 | B1 | 11/2001 | Bigoszewski et al. | |
| 6,416,088 | B1 * | 7/2002 | Graute | 292/216 |
| 6,499,776 | B2 * | 12/2002 | Takamura | 292/201 |
| 6,601,883 | B1 | 8/2003 | Kalsi | |
| 6,659,515 | B2 * | 12/2003 | Raymond et al. | 292/201 |
| 6,764,113 | B1 | 7/2004 | Cetnar | |
| 6,843,085 | B2 | 1/2005 | Dimig | |
| 6,848,727 | B1 * | 2/2005 | Cetnar et al. | 292/201 |
| 7,014,228 | B2 * | 3/2006 | Hirai | 292/341.16 |
| 7,175,228 | B2 * | 2/2007 | Mrkovic et al. | 296/155 |
| 7,338,128 | B2 * | 3/2008 | Inoue et al. | 297/378.13 |
| 7,367,598 | B2 * | 5/2008 | Arabia et al. | 292/341.16 |
| 7,445,258 | B2 * | 11/2008 | Rice et al. | 292/341.16 |
| 7,959,205 | B2 * | 6/2011 | Paing et al. | 296/65.03 |
| 8,322,761 | B2 * | 12/2012 | Itami et al. | 292/201 |
| 8,474,887 | B2 * | 7/2013 | Suzuki et al. | 292/201 |
| 8,485,571 | B2 * | 7/2013 | Shinoda et al. | 292/201 |
| 2001/0010429 | A1 * | 8/2001 | Jyawook et al. | 292/347 |
| 2003/0214137 | A1 | 11/2003 | Mejean et al. | |
| 2005/0200137 | A1 | 9/2005 | Nelsen et al. | |
| 2006/0006671 | A1 | 1/2006 | Noel et al. | |
| 2006/0049639 | A1 | 3/2006 | Menke | |
| 2006/0220391 | A1 | 10/2006 | Baraganon | |
| 2006/0237974 | A1 | 10/2006 | Hamm et al. | |

* cited by examiner

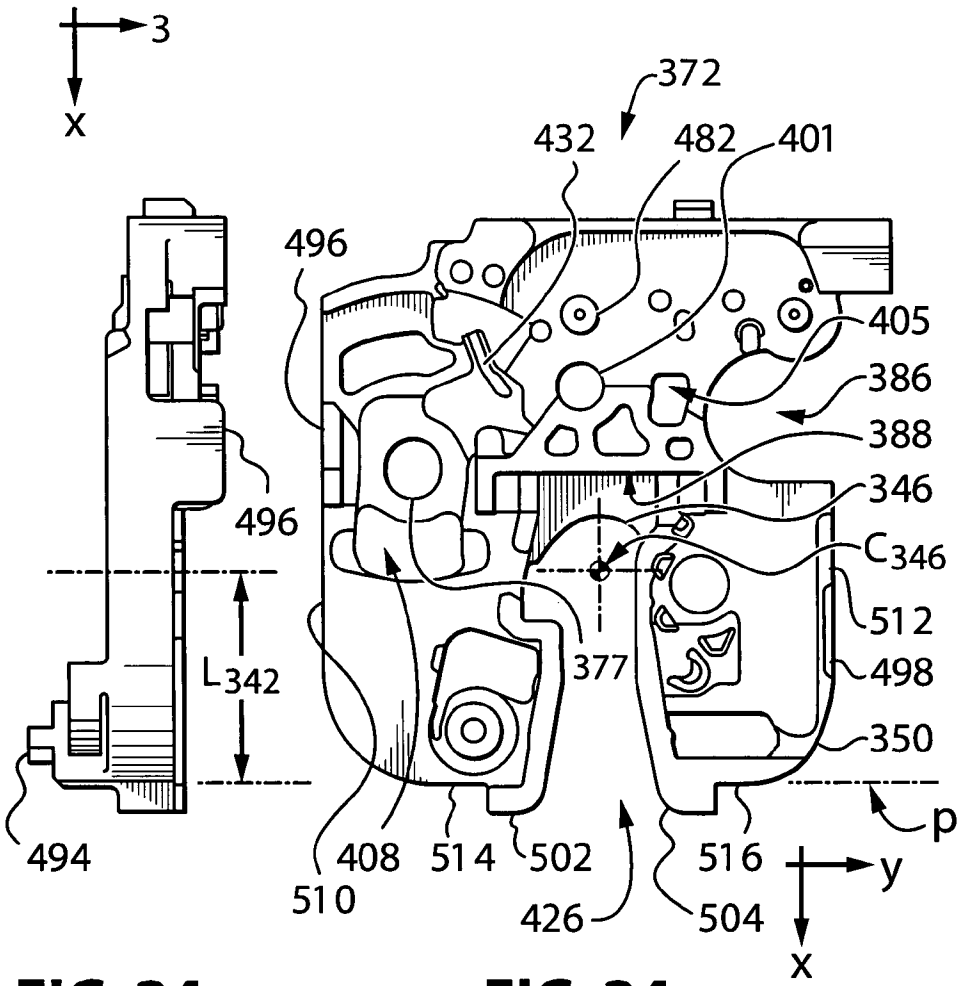
FIG. 24c
FIG. 24e
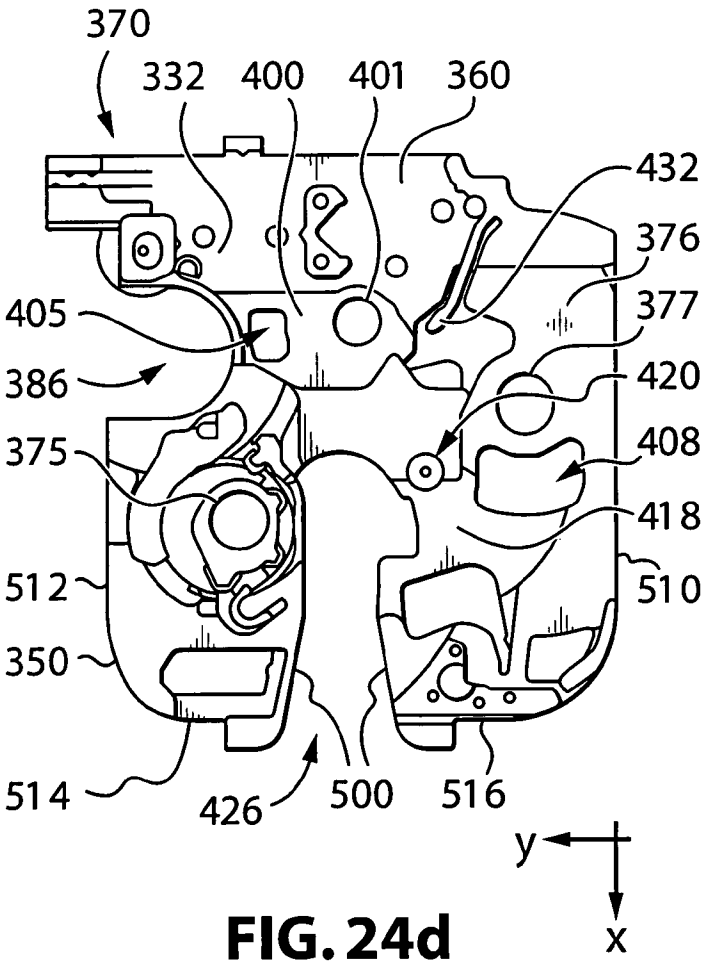
FIG. 24d

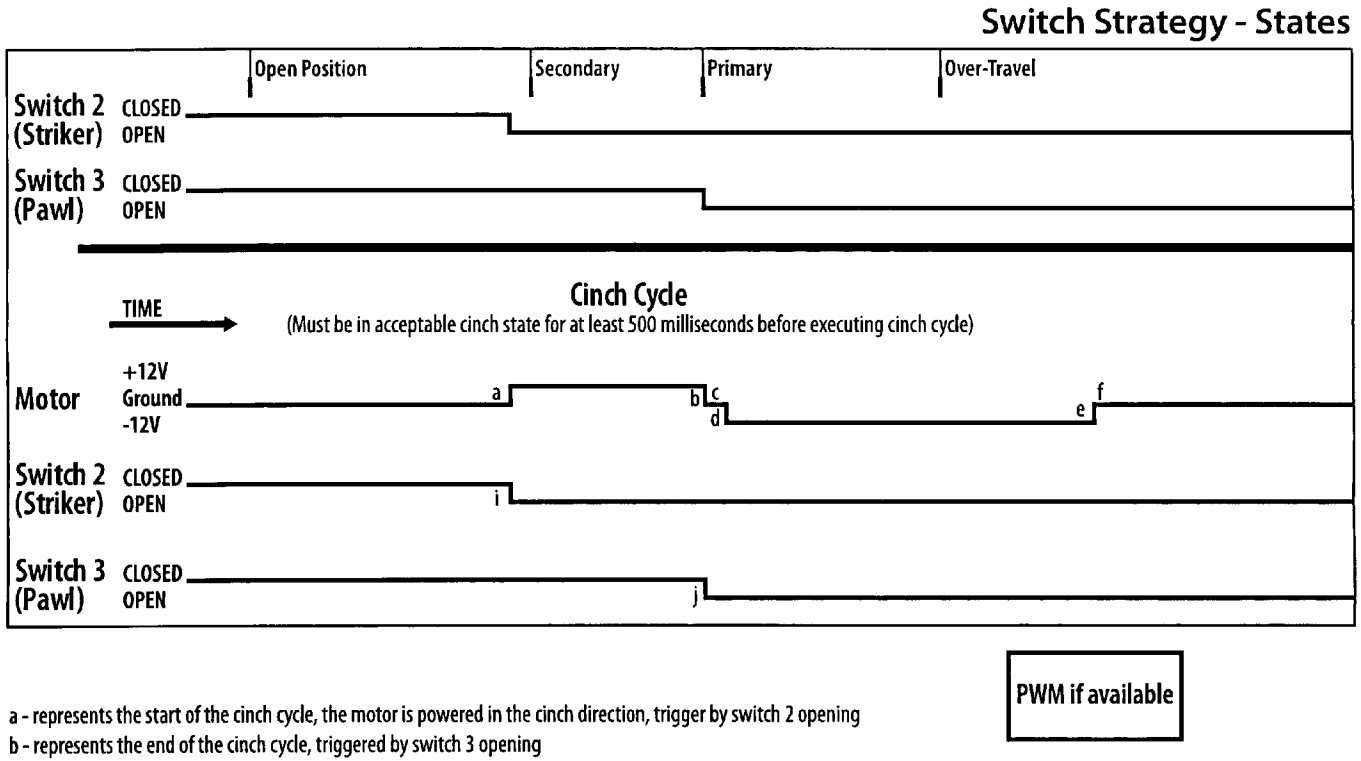

a - represents the start of the cinch cycle, the motor is powered in the cinch direction, trigger by switch 2 opening
b - represents the end of the cinch cycle, triggered by switch 3 opening
c - represents a delay and dynamic braking
d - represents powering the motor in the release direction to find home
e - represents stopping the motor and applying dynamic braking, triggered by switch 1 opening (or timeout if PWM is available)
f - represents the motor in a steady state dynamically braked condition
i - represents switch 2 opening due to the latch being put into the secondary position
j - represents switch 3 opening due to the latch being put into the primary position

FIG. 26a

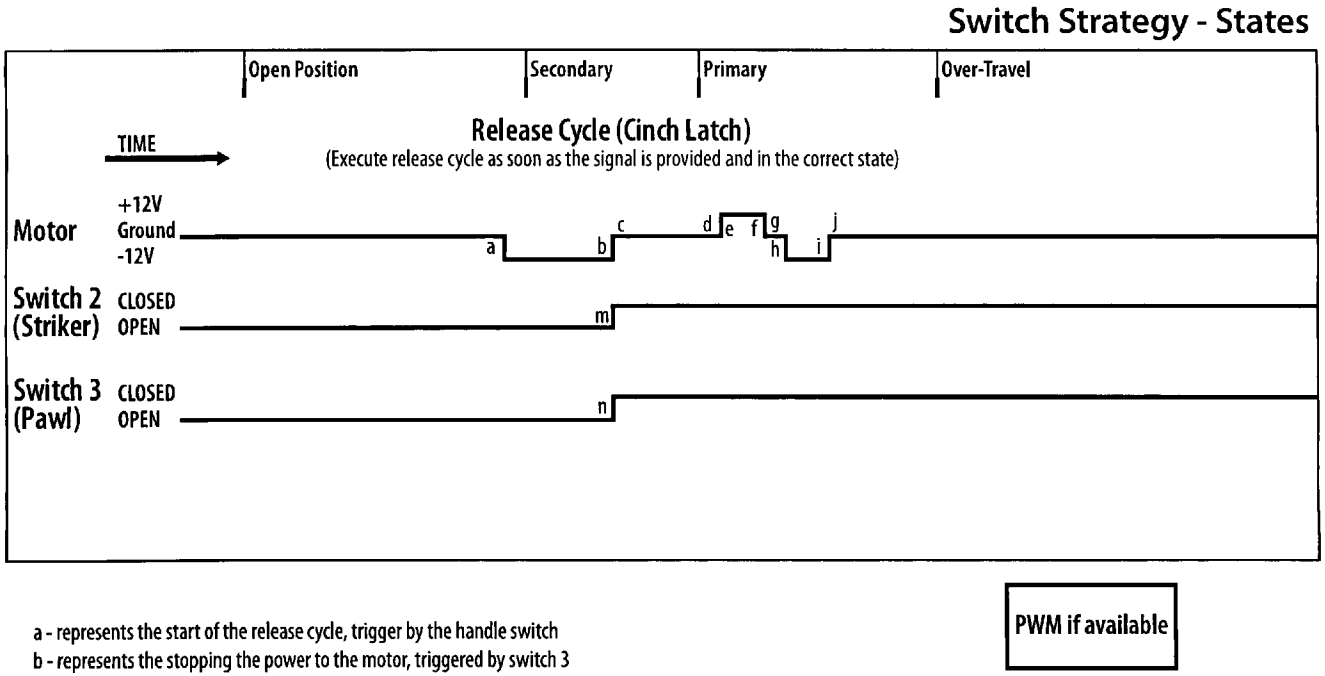

a - represents the start of the release cycle, trigger by the handle switch
b - represents the stopping the power to the motor, triggered by switch 3
c - represents the start of the snowload pawl hold open
d - represents the end of the snowload pawl hold open, triggered by a fixed time after the latch releases
e - represents powering the motor in the cinch direction
f - represents stopping the motor and applying dynamic braking, triggered by switch 1 closing (or timeout if PWM is available)
g - represents a delay and dynamic braking
h - represents powering the motor in the release direction, this starts the find home sequence
i - represents stopping the motor and applying dynamic braking, triggered by switch 1 opening (or timeout if PWM is available)
j - represents the motor in a steady state dynamically braked condition
m - represents switch 2 closing represents the latch released
n - represents switch 3 closing represents the latch released

FIG. 26b

MODULAR LATCH

CROSS-REFERENCE TO RELATED APPLICATIONS

This application is a national entry application of PCT International Application No. PCT/CA2008/000380 filed Feb. 28, 2008 which claims the benefit of U.S. Provisional Application No. 60/892,031, filed Feb. 28, 2007, the contents of which are incorporated herein in their entirety.

FIELD OF THE INVENTION

The present invention relates to automotive door latches, such as may be used in such things as lift gates, deck lids, or sliding doors.

BACKGROUND OF THE INVENTION

Latch designs need to accommodate different packaging requirements for lift gates, decklids and sliding doors. In addition, automotive companies are looking to provide new features for their vehicles, even on components such as latches. Features such as power locking, power releasing and power cinching are rapidly becoming popular. Other manufacturers desire simpler and less expensive locks. The need for multiple latch packages and feature sets results in the need for multiple latch designs while manufacturers are looking to standardize parts in order to reduce assembly costs. Therefore, it may be desirable to produce a modular latch that can accommodate different features within one assembly.

Additionally, in a vehicle collision, there is the potential that sudden deceleration may generate an inertial load on either the ratchet or pawl to accidentally release the latch. This may not be desirable.

For latches with power cinching, the controller needs to know the position of the ratchet (released, primary engaged, secondary engaged position), in order to know when to begin and when to stop the cinching motor. Typically, switches triggered by either the ratchet or the pawl, or both, tend to report on the ratchet position. FIG. 1*a* shows a prior art switching strategy. One switch is triggered by the ratchet, and another switch is triggered by the pawl. The ratchet switch has an OFF state when the ratchet is rotated into the release position, and an ON state when the ratchet is rotates past the secondary and preferably close to the primary engagement positions. To compensate for operational variances, there is a slight lag between the ratchet reaching the primary engagement position and the ratchet switch indicating that the ratchet is engaged. The pawl switch has a OFF position that corresponds to the pawl being actuated away from the ratchet, and an ON position, which corresponds to when the pawl retains the ratchet in either the secondary or primary engagement positions. One problem with this switch strategy is that the switches report the same state (OFF and OFF) when the ratchet is in the primary engagement position, and an interlude between the primary and secondary engagement positions. The controller is forced to use additional intelligence to provide the desired cinching effect, resulting in increased complexity and more expensive components.

A second prior art switch strategy, shown in FIG. 1*b*, uses two switches, but with both switches contacting the ratchet at different parts of the ratchet's travel between released, secondary engagement and primary engagement positions. The first ratchet switch works as the ratchet switch described above. The second ratchet switch is positioned elsewhere along the ratchet's travel path so that it is off when the ratchet is released, switches ON while the ratchet travels from secondary to primary engagement positions, and then switches off again. As before, operational variances require that there be a lag between the transition of the switch state and the ratchet position. While this switch strategy avoids the OFF, OFF scenario described above, the second ratchet switch is not turned off until after the ratchet reaches the primary engagement position. This results in the motor continuing to cinch briefly, but disquietingly, after the latch is fully closed in the primary engagement position.

Finally, it is generally desirable to reduce the cost of producing the latch. This includes reducing the product design and development costs, design validation and production validation test costs by using previously designed and validated components. This may reduce the number of components used during assembly, the time required to assemble the latch, and the cost of the components generally.

SUMMARY OF THE INVENTION

In an aspect of the invention there is a modular latch for an automotive vehicle. It has a latch core. The latch core has a housing and a ratchet and pawl rotatably mounted to the housing. The ratchet and pawl are cooperatively operable to move between an engaged position to hold a striker and a released position. The latch core is operable to be secured to one of a plurality of mounting plates to secure and present the latch core to the striker. The plurality of mounting plates may include (a) a mounting plate for a lift gate latch, (b) a mounting plate for a decklid latch, and (c) a mounting plate for a sliding door latch. The latch core is further operable to mount any one of a plurality of latch modules, including a manual release latch module, a power release latch module, a power lock and unlock latch module, and a power cinching and release latch module.

In another aspect of the invention there is a latch for an automotive vehicle. It has a latch core. The latch core has a housing and a ratchet and pawl rotatably mounted to the housing. The ratchet and pawl are co-operable to move between an engaged position to hold a striker and a released position. The latch core has securement fittings attachable to any one of a plurality of mounting plates of a set of mounting plates for securing the latch core to a vehicle in a position to present the latch core to the striker. The set of mounting plates includes: a mounting plate for a lift gate latch, a mounting plate for a decklid latch, and a mounting plate for a sliding door latch. The latch core has operational connections attachable to at least one other latch module of a set of other latch modules. That set includes: a manual release latch module, a power release latch module, a power lock and unlock latch module, and a power cinching and release latch module.

In a feature of that aspect of the invention, the core latch further includes a cover plate mounted to the housing, and a channel for receiving a striker defined in each of the mounting plate, the housing and the cover plate. The ratchet and pawl are cooperable to move between a primary engagement position to hold the striker in the channel, a secondary engagement position to hold the striker in the channel, and a released position to permit the striker to exit the channel. The ratchet and pawl are biased toward the primary and secondary engagement positions. The pawl is pivotable about a pawl axis. A secondary pawl is pivotally mounted to the housing on an axis offset from the pawl axis. The secondary pawl is kinematically coupled at a first end to the pawl, and has an out-of-plane tab mounted to drive the pawl. The secondary pawl is mounted to drive the pawl in a rotational direction opposite to the pawl.

In another aspect of the invention there is a latch for an automotive vehicle. It has a housing and a ratchet and pawl pair. The ratchet and pawl are rotatably mounted to the housing and are co-operable to move between a mutually engaged position for holding a striker and a released position. There is a secondary pawl, rotatably mounted to the housing and operable to actuate the pawl to release the ratchet. The pawl and secondary pawl each have a center of rotation and a center of gravity. The centers of rotation and centers of gravity are substantially coincident for the pawl and the secondary pawl respectively.

In a further aspect of the invention there is an automobile latch core for mounting between an outside enclosure member and an inside backing plate in a mechanical sandwich having a fishmouth for admitting a matably engageable striker. The latch core includes a substrate; a ratchet and ratchet biasing member; a pawl and pawl biasing member; and at least a first status sensor member and an associated first status sensor switch. The substrate has accommodations for the ratchet, the ratchet biasing member, the pawl and the pawl biasing member, and for the first status sensor member and the first status sensor switch. The latch core has a fishmouth. The latch core has an inner end of the fishmouth having cinched striker center position. Excluding indexing protrusions and fishmouth wear members, the latch core has a predominant width, W, longitudinally endwardly of the cinched striker center position, a length L from the striker center position to the fishmouth end, and a through thickness t between the outside enclosure member and the backing plate wherein W is less than 65 mm, L is less than 35 mm, and t is less than 20 mm.

In a further feature of that aspect of the invention, (a) W is less than 60 mm; (b) L is less than 32 mm; and t is less than 16 mm. In a still further feature, (a) W is less than 60 mm; (b) L is less than 32 mm; and (c) t is less than 16 mm. In a yet further feature, W is in the range of 50-55 mm; L is in the range of 25-32 mm; and t is less than 15 mm.

In another aspect of the invention there is a method of operating a latch for an automobile, the latch having a housing having a slot for receiving a striker, a cooperating ratchet and pawl pair mounted to the housing, and at least one sensor and sensor switch pair mounted to the housing, wherein the method includes using the sensor to check directly for the presence of a striker in the slot, and driving the ratchet to cinch the striker when there is a signal that the striker is present in the slot.

In still another aspect of the invention there is a latch for an automobile, the latch having a housing having a slot for receiving a striker, a co-operating ratchet and pawl pair mounted to the housing, and at least one sensor and sensor switch pair mounted to the housing, the sensor being mounted to monitor directly for the presence of a striker in the slot, and the latch is operable to drive the ratchet to cinch the striker in response to a signal from the switch that the striker is present in the slot.

In a further feature of that aspect, the latch has both a first sensor member and a second sensor member monitoring for the presence of a striker in the slot. In another feature, the first sensor member monitors for striker presence in at least an entrance portion of the slot, and the second sensor member monitors for striker presence in at least an innermost portion of the slot distant from the entrance portion.

In still yet another aspect of the invention, there is a latch core substrate for a latch assembly of an automobile. The substrate is formed of a molded monolith. The substrate includes accommodations for at least a ratchet, a pawl, a first status sensor member, and an associated first status sensor switch. The substrate includes an integrally formed movable member interposed between the accommodation for the first status sensor switch and the first status sensor member. The movable member is positioned to be acted upon by the first status sensor member; and the movable member is positioned to act upon the first status sensor switch when acted upon by the first status sensor member.

In a still further aspect of the invention, there is a latch core substrate for a latch assembly of an automobile. The substrate is formed of a molded monolith having a striker motion accommodating slot defined therein. The substrate includes accommodations for at least a ratchet, a pawl, a first status sensor member, and an associated first status sensor switch. The substrate includes a first fitting array defining a first latch core layer, the first latch core layer including the accommodations for the ratchet and the pawl. The substrate includes a second fitting array defining a second latch core layer, and the second latch core layer includes the accommodation for the first status sensor member.

In a further feature, the substrate includes fittings defining a third latch core layer. In another feature, the third layer has fittings defining a snowload lever seat. In another feature, the substrate includes communication passages between at least two of the layers.

In still another feature, there is a latch core for a latch assembly of an automobile, the latch core including the aforesaid substrate, a ratchet, a pawl, a first status sensor member, and an associated first status sensor switch each seated in its respective accommodation. The first status sensor member being operable to sweep through a range of motion, the range of motion overlapping at least part of the striker motion accommodating slot. The first status sensor member being operable independently of the ratchet. The first status sensor member is operable independently of the pawl.

In another aspect of the invention there is a latch for an automobile. The latch has a housing having a slot for receiving a striker; a co-operating ratchet and pawl pair mounted to the housing; a first sensor and associated first sensor switch mounted to the housing; and a second sensor and associated second sensor switch mounted to the housing. The first sensor is mounted to obstruct the slot, and is movable from the slot by the striker, the first switch being operably connected to change state on movement of the first sensor. The second sensor being a pawl position monitoring sensor.

In a feature of that aspect, no sensor of the latch is connected to monitor ratchet position. In another feature, there is a method of operating the latch, that includes (a) monitoring for a change of state of the first switch to signify the presence of a striker in the slot; (b) monitoring the second switch for the presence of a state associated with the presence of a bias of the pawl to engage the ratchet and prevent opening movement thereof; and (c) driving the ratchet toward the closed position when conditions (a) and (b) are satisfied. In another feature there is a method of releasing the latch including driving the pawl release to a release position; polling the first switch for a change in state signifying outward motion of the striker; polling the second switch for a change of state signifying arrival of the striker at a fully released state.

In another aspect of the invention there is a latch core for a latch assembly of an automobile. The latch core has a mounting substrate having a striker motion accommodating slot formed therein; a ratchet, a pawl, a first status sensor member, and an associated co-operable first status sensor switch each seated in a respective accommodation of the mounting substrate. The first status sensor member is operable to sweep through a range of motion that overlaps at least part of the striker motion accommodating slot. The first status sensor member is operable independently of the ratchet and independently of the pawl.

The various aspects of the invention may also include the use, or methods of use of the apparatus shown, described, or claimed herein. These and other aspects and features of the invention may be understood with reference to the description which follows, and with the aid of the illustrations of a number of examples.

BRIEF DESCRIPTION OF THE FIGURES

The description is accompanied by a set of illustrative Figures in which:

FIG. 24*c* is a top plan view of the latch core housing of FIG. 24*a;*

FIG. 24*d* is a bottom plan view of the latch core housing of FIG. 24*a;*

FIG. 24*e* is a side view of the latch core of FIG. 24*a;*

FIG. 26*a* shows a logic chart for cinching of the latch core of FIG. 25*a*; and FIG. 26*b* shows a logic chart for the release cycle of the latch core of FIG. 25*a*.

DETAILED DESCRIPTION

Figure 1A:
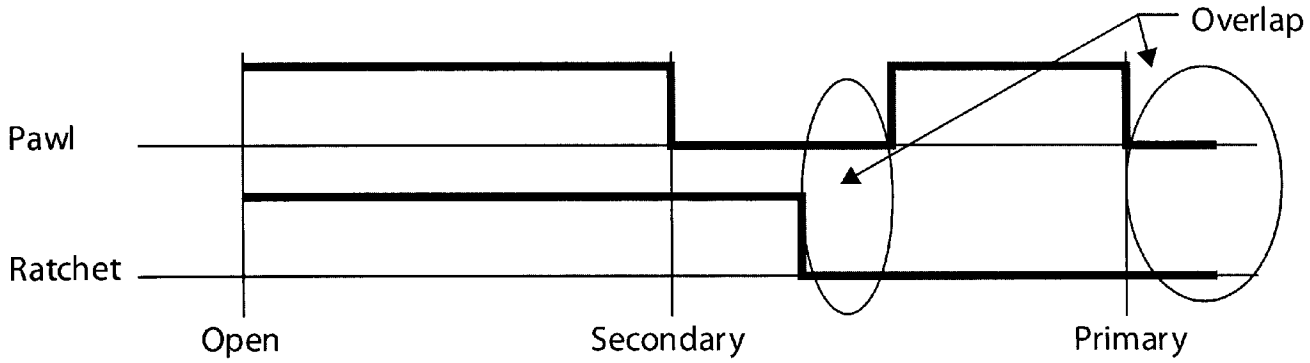
FIG. 1A (PRIOR ART)
FIGS. 1*a* and 1*b* provide tables showing a prior art switching strategies.

The description that follows and the embodiments described therein are provided by way of illustration of an example, or examples, of particular embodiments of the principles, aspects or features of the present invention. These examples are provided for the purposes of explanation, and not of limitation, of those principles and of the invention. In the description, like parts are marked throughout the specification and the drawings with the same respective reference numerals. The drawings are generally to scale unless noted otherwise, although the scale may differ from drawing to drawing. Reference to directions such as up and down, front and back, left and right, top and bottom, may tend to be arbitrary, and these terms may be used for convenience rather than to define a required orientation, unless noted otherwise. The terminology used in this specification is thought to be consistent with the customary and ordinary meanings of those terms as they would be understood by a person of ordinary skill in the automobile industry in North America. The Applicant expressly excludes all interpretations that are inconsistent with this specification.

Figure 2:
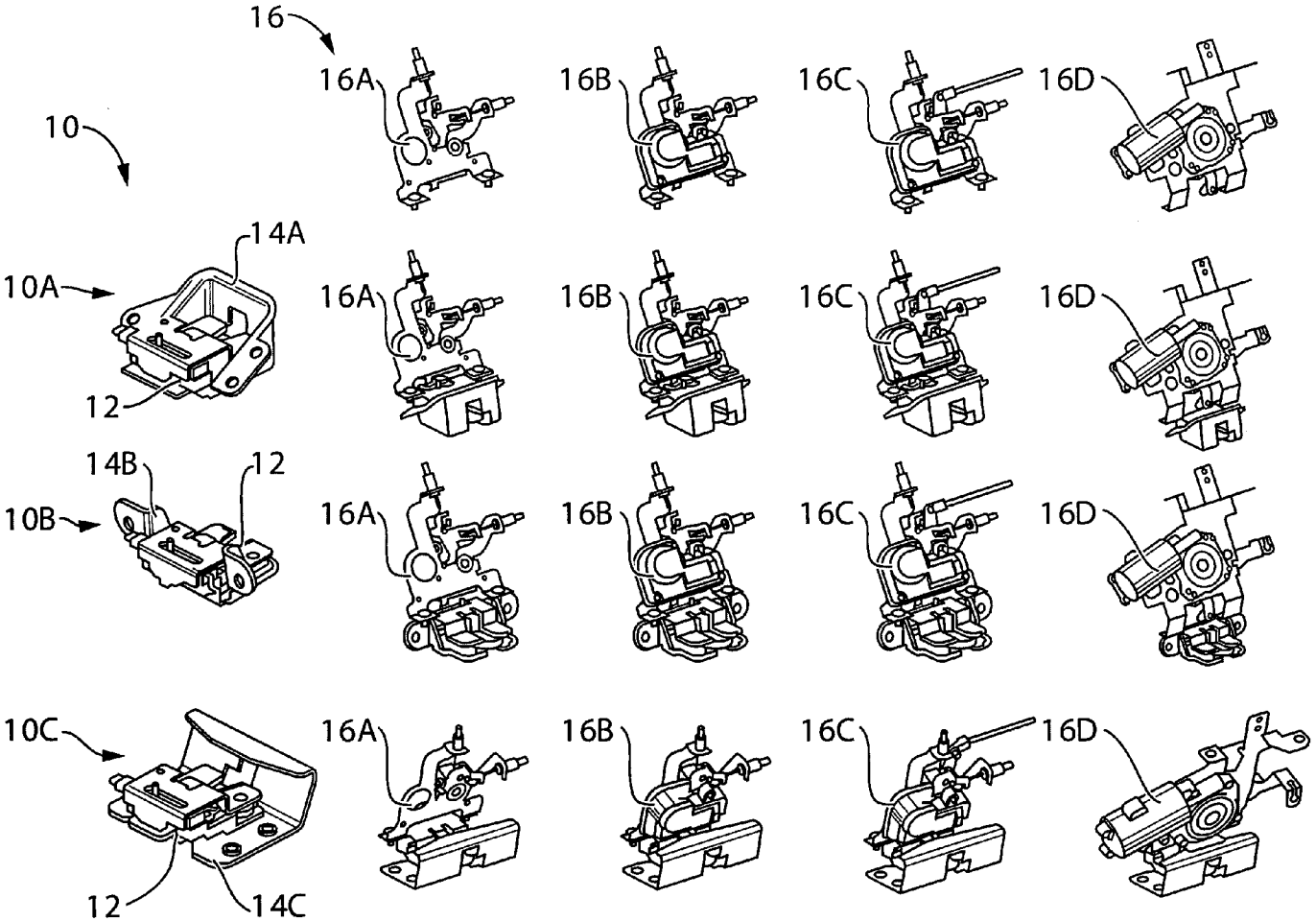
FIG. 2 shows a modular latch having multiple configurations in accordance with a first aspect of the invention.

FIG. 2, shows an array, or matrix, of combinations of latch assembly modules such as may be mixed and matched to arrive at a latch suitable for any of a range of employments. In FIG. 2, a latch module is shown generally at 10. Modular latch 10 is adapted to receive a striker from a number of different closure panels, including a liftgate, a decklid or a sliding door (none shown). Modular latch 10 can be employed in a number of different configurations, including a liftgate latch 10*a*, a decklid latch 10*b* and a sliding door latch 10*c*. References made to modular latch 10, as opposed to latch 10*a*, 10*b* or 10*c* describe features held in common between all different configurations of modular latch 10. Each different configuration of modular latch 10 includes a common latch core 12 that is the same for all configurations. Latch core 12 is described in greater detail below.

A specially-adapted mounting plate 14 is used to mount latch core 12 to the vehicle. Mounting plate 14 is used for the liftgate latch 10*a*, mounting plate 14*b* is used for the decklid latch 10*b*, and mounting plate 14*c* is used for the sliding door latch 10*c*. References made to mounting plate 14, as opposed to mounting plate 14*a*, 14*b* or 14*c* describe features held in common between all different configurations of mounting plate 14. Mounting plate 14 may be a stamped metal component that includes the required flanges and fastener holes to mount it to the vehicle body, and is shaped to present the latch core 12 to a striker (not shown) to secure the latch. A latch module 16 is mounted to the latch core 12 for all of the different configurations of modular latch 10. Additionally, there a number of different latch modules that each provide a specific functionality to the various latch configurations. Latch module 16*a* provides for manual release of latch 10 only. Latch module 16*b* provides for both power release and manual release of latch 10. Latch module 16*c* adds power locking and unlocking to the functionality of latch module 16*a*. Latch module 16*d* adds power cinching and release to the features described above. The various types of latch modules 16 will be described in greater detail below.

Figure 8A:
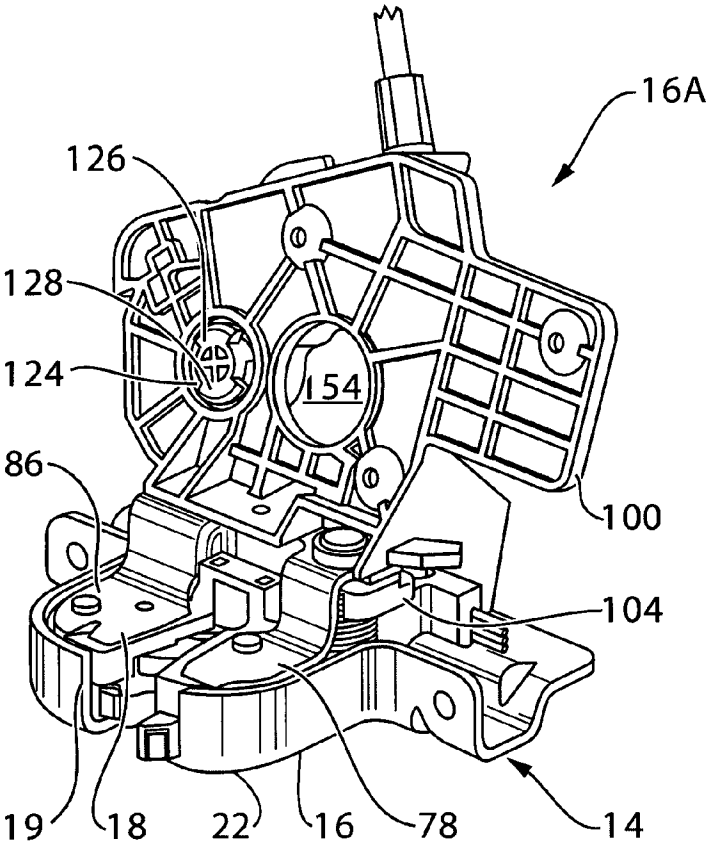
FIG. 8*a* shows a manual release module mounted to the latch core of FIG. 3.
Figure 9:
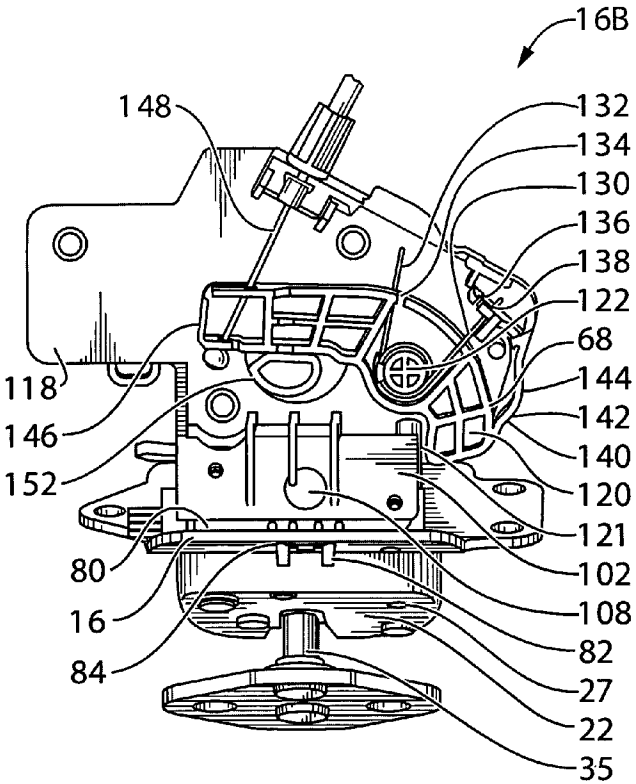
FIG. 9 is a side plan view for a power release module for the modular latch of FIG. 2.

Latch core 12 is shown in greater detail in FIGS. 3 to 6. Latch core 12 includes a housing 18 that houses the latch core components, and retains them in place during normal operation and shipment. Housing 18 may be formed of a molded thermoplastic material. Housing 18 includes a substrate 20 that, when secured to the mounting plate 14, is generally parallel to substrate 22 found on the mounting plate 14 (FIG. 8*a*). A sidewall portion 24 runs partially along the edges of substrate 20. Mounting posts 26 extend from substrate 20, and are sized as to fit within apertures 27 in mounting plate 14, thereby locating core latch 12 on mounting plate 14 (FIG. 9). As will be described in greater detail below, the ratchet and pawl assembly fastens latch core 12 to mounting plate 14.

A compartment 28 is formed between housing 18, and sidewalls 19 and substrate 22 of mounting plate 14 to house various latch components. A ratchet 30 and pawl 32 are mounted within compartment 28. Ratchet 30 and pawl 32 may be made of metal, which may be covered with, or encapsulated in a plastic material to some extent to reduce noise during operation. Certain portions subject to wear, such as the ratchet teeth are not covered by plastic. A tapering channel, referred to as a "fishmouth" 34 bisects substrate 22. In operation, fishmouth 34 receives a striker 35 (FIG. 9), which engages a hook arm 36 of ratchet 30. An end-of travel, elasometric or rubber overslam bumper 38 is mounted at the inner end of fishmouth 34. Bumper 38 receives and absorbs the impact of the striker 35, and may tend to reducing noise.

Figure 19B:
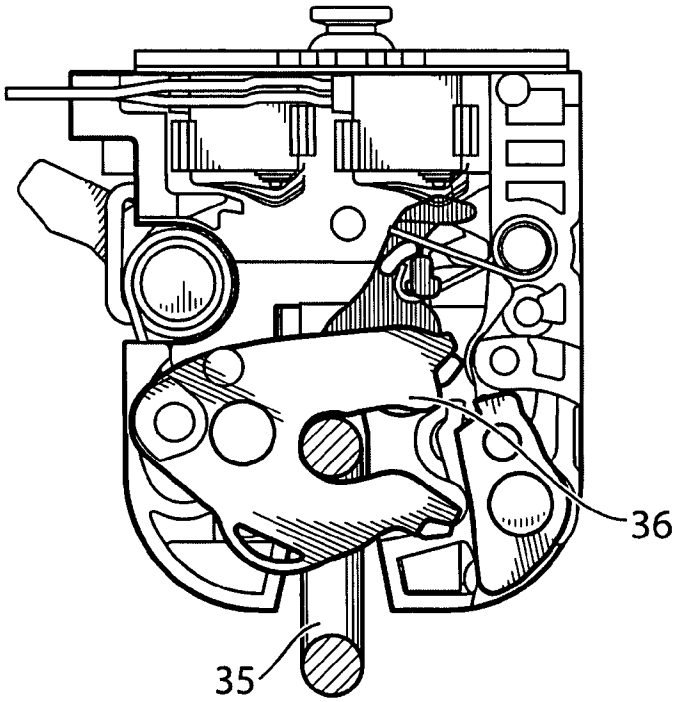
FIG. 19*b* shows a top plan view of the latch core shown in FIG. 3, featuring a striker entering a latch having the ratchet in between the primary and secondary engagement positions.
Figure 19A:
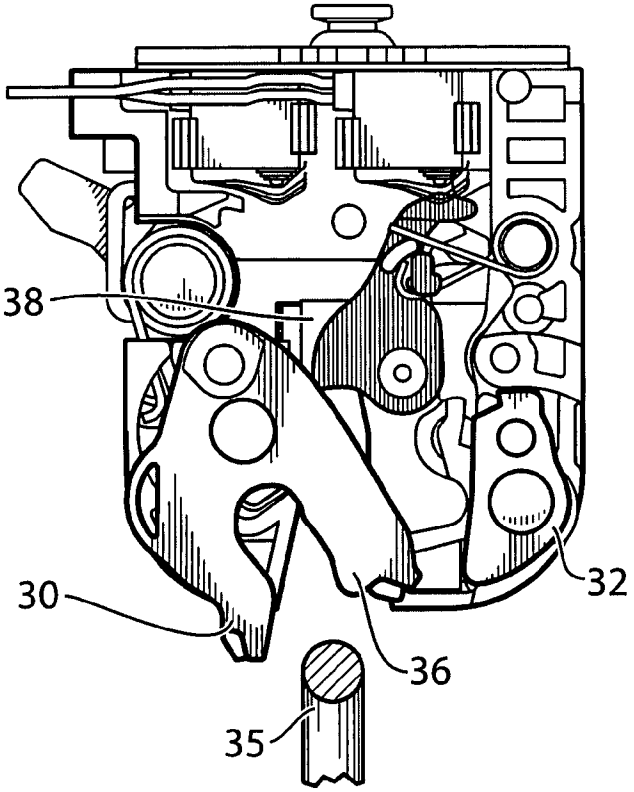
FIG. 19*a* shows a top plan view of the latch core shown in FIG. 3, featuring a striker entering a latch having the ratchet in the released position.
Figure 19D:
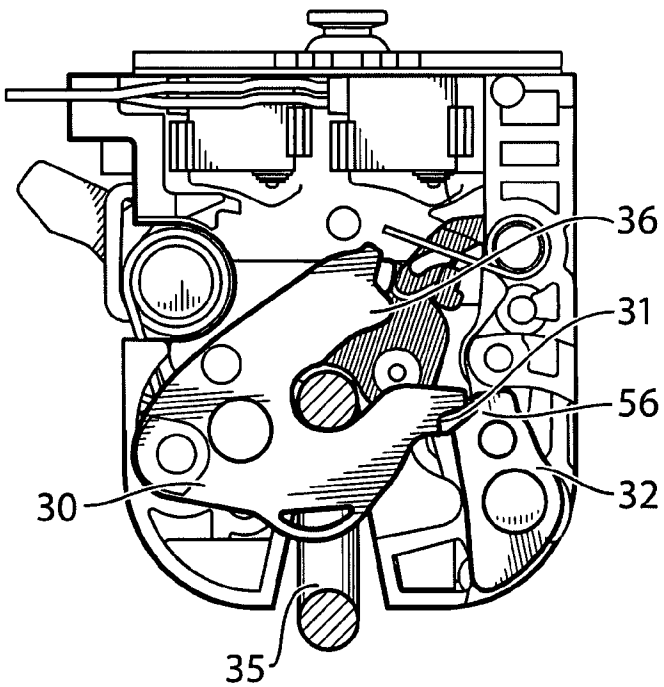
FIG. 19*d* shows a top plan view of the latch core shown in FIG. 3, featuring a striker entering a latch having the ratchet in the primary engagement position.

Ratchet 30 is pivotally secured to substrate 20 by a ratchet rivet 42 inserted into aligned holes provided in substrates 20, 22 and ratchet 30. Ratchet 30 is pivotable between a "primary engagement", or fully clinched, position (FIG. 19*d*), where a primary tooth 31 of ratchet 30 is retained by pawl 32; a "secondary engagement" position, where a secondary tooth 36 of ratchet 30 is retained by pawl 32 (FIG. 19*b*), and a "released" position (FIG. 19*a*). When a striker 35 enters fishmouth 34, it engages hook arm 36, thereby rotating ratchet 30 towards the primary engagement position. A ratchet spring 50 urges ratchet 30 towards the released position. Rotating ratchet 30 towards the engagements positions compresses ratchet spring 50.

Pawl 32 is pivotally mounted to substrate 20 by a pawl rivet 52 inserted into aligned holes in substrates 20, 22, and pawl 32. Pawl 32 is movable between an "engaged" position where it abuts either primary tooth 31 (FIG. 19*d*) or secondary tooth 36 (FIG. 19*b*) on ratchet 30, and a released position (19*a*), where it is rotated away from ratchet 30 to permit ratchet 30 to rotate towards its released position. When ratchet 30 is in its released position, pawl 32 is retained in the engaged position by secondary pawl 60 and secondary pawl bumper. A ratchet shoulder 56 on pawl 32 abuts either primary tooth 31 on ratchet 30 or secondary tooth 36 when ratchet 30 is in its primary or secondary engagement positions, respectively, preventing ratchet 30 from rotating towards the released position. A pawl spring 58, mounted around pawl rivet 52 urges pawl 32 towards the engaged position. Rotating pawl 32 to the released position compresses pawl spring 58.

A secondary pawl 60 is pivotally mounted the side of housing 18 opposite substrate 20 along axle 62. A first end 64 of secondary pawl 60 is kinematically coupled with pawl 32 within an aperture 65 in housing 18 (FIG. 5), so that pivoting one of pawl 32 and secondary pawl 60 pivots the other in the opposing direction. A second end 66 of secondary pawl 60 includes a depending tab 68 which extends through a slot 70 in an auxiliary cover plate (described below) which can be actuated by a release lever (also described below). A tab 72 depends from pawl 32, extends through aperture 65, and is fitted into a socket 74 on the first end 64 of secondary pawl 60, kinematically coupling pawl 32 and secondary pawl 60 together. The effective center of gravity of the combined pawl 32 and secondary pawl 60 is also the effective center of rotation for the coupled pawls. Thus, there are no inertial events acting on either of pawl 32 or secondary pawl 60 during a sudden deceleration (i.e., a crash) to cause pawl 32 to actuate ratchet 30, thereby reducing the chances of the latch 10 accidentally releasing.

Figure 5:
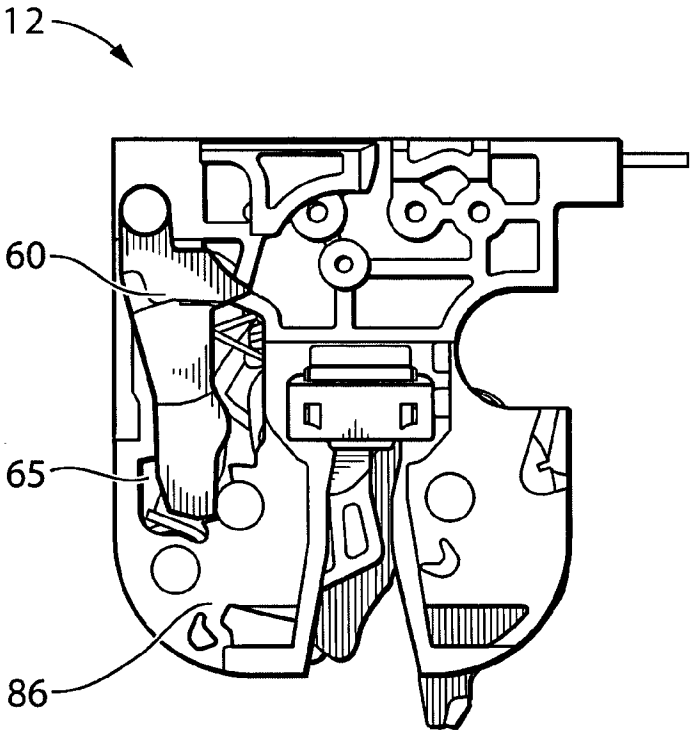
FIG. 5 shows a bottom plan view of the latch core shown in FIG. 3, having the latch plate removed.
Figure 4:
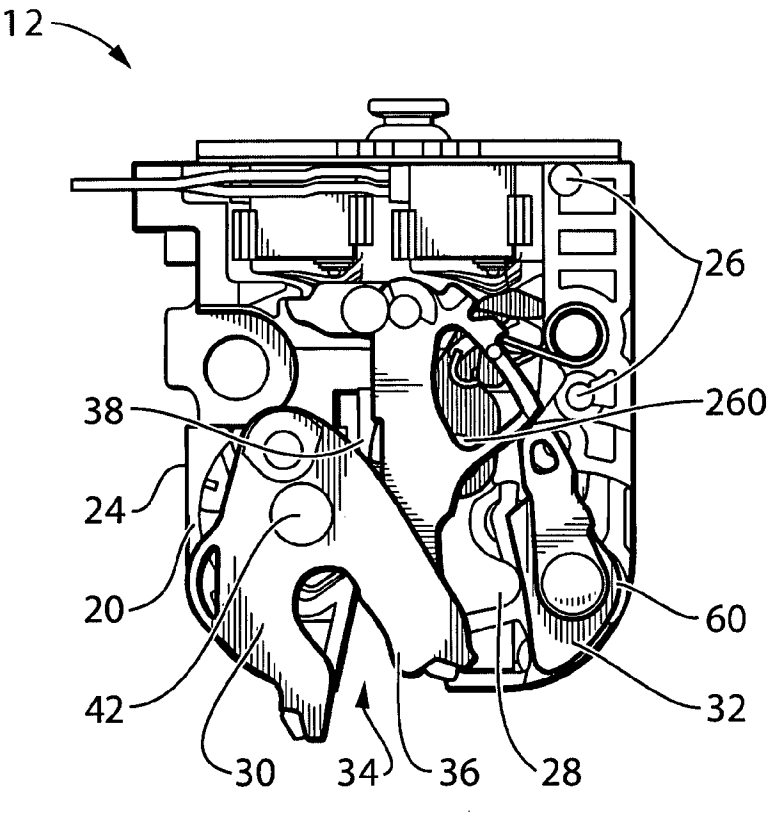
FIG. 4 shows a top plan view of the latch core shown in FIG. 3, having the latch plate removed.
Figure 7:
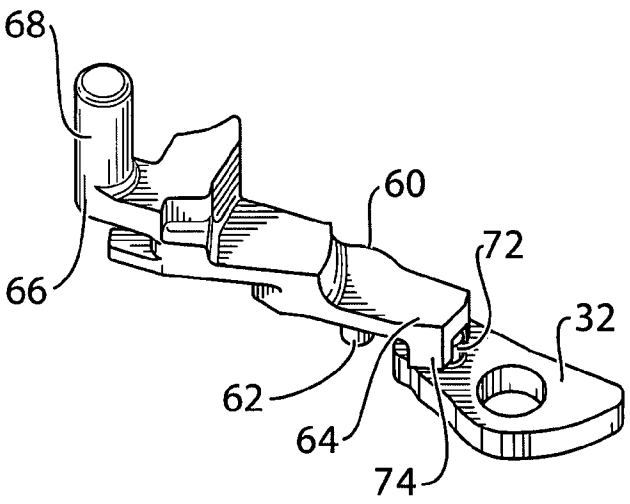
FIG. 7 shows an isolated view of a pawl and secondary pawl for the latch core shown in FIG. 3.

Referring now to FIGS. 3, 8*a*, 8*b* and 9, a cover plate 76 is provided on the side of housing 18 opposite compartment 28. Cover plate 76 may be a metal stamping. Cover plate 76 is secured to housing 18 primarily by ratchet rivet 42 and pawl rivet 52. Additional fasteners may also be used. Cover plate 76 includes a substrate 78 that is generally parallel to substrates 20 and 22, and a sidewall 80 that runs generally perpendicular to substrate 78. When core latch 12 is attached to mounting plate 14, sidewall 80 abuts mounting plate 14. Sidewall 80 has edge tabs 82. Tabs 82 extend through a slot 84 on mounting plate 14. FIG. 5 illustrates a compartment 86 formed between cover plate 76 and housing 18, opposite compartment 28. As noted, secondary pawl 60 is housed within compartment 86.

Figure 3:
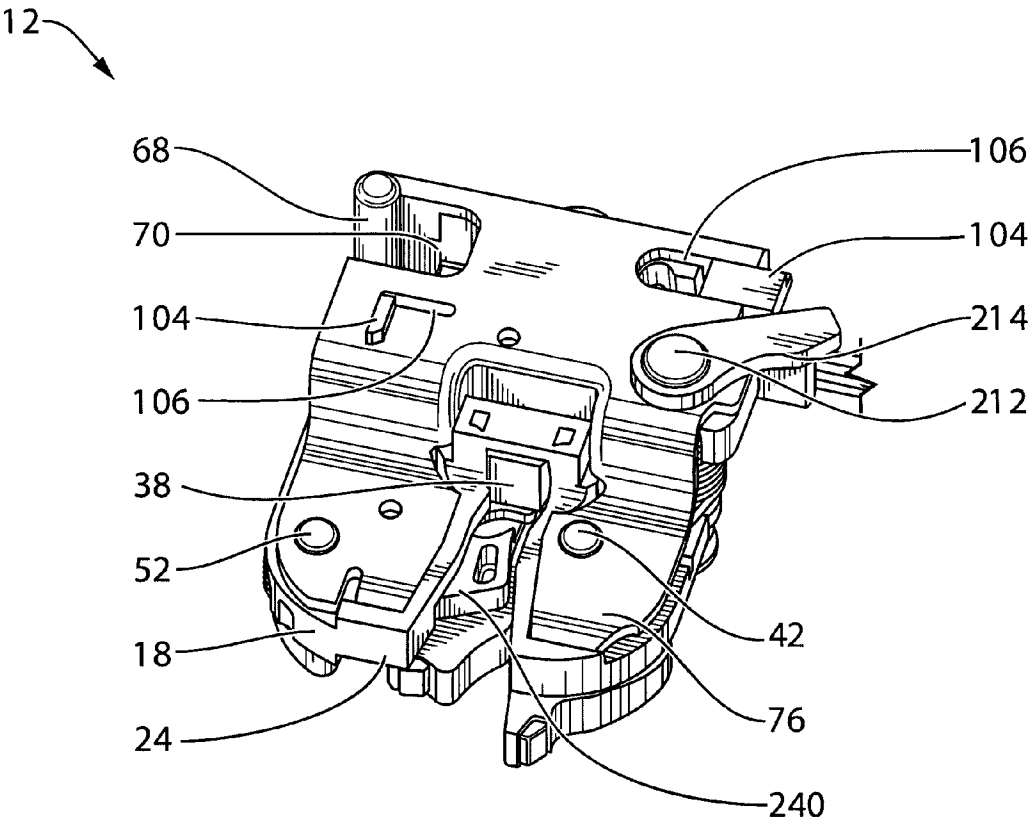
FIG. 3 shows a perspective view of a latch core used in the modular latches shown in FIG. 2.

As noted above, latch module 16 is mounted to latch core 12 to provide release, power locking or cinching functionality, or all of them. FIGS. 8 to 15 illustrate three different latch modules, 16*a*, 16*b* and 16*c* in various states of operation. Each latch module 16 includes a base adapter or brain plate 100. The shape of brain plate 100 may vary due to the hardware mounted thereon, but each includes standardized mounting components to allow the different latch modules 16 to be mounted to the common latch core 12. Brain plate 100 may be made of plastic to reduce cost and weight. Each brain plate 100 includes a mounting flange 102 that sits against sidewall 80 on cover plate 76. Along mounting flange 102, there is a pair of anchoring hooks 104. One anchoring hook 104 (FIG. 3) is inserted through slot 106 along the edge of cover plate 76, and the other anchoring hook 104 is inserted into slot 106 with the surface of cover plate 76 (FIG. 3). A fastener 108 extends through aligned apertures 110 in mounting flange 102 and side wall 80 of cover plate 76. Once slid into place, anchoring hooks 104, and fastener 108 provide a tight fit, holding latch module 16 in place. This mounting arrangement transfers the load from plastic latch module 16 to metal cover plate 76. Optional fastener apertures 112 can be provided in both brain plate 100 and cover plate 76 for additional fasteners, if desired.

Figure 8B:
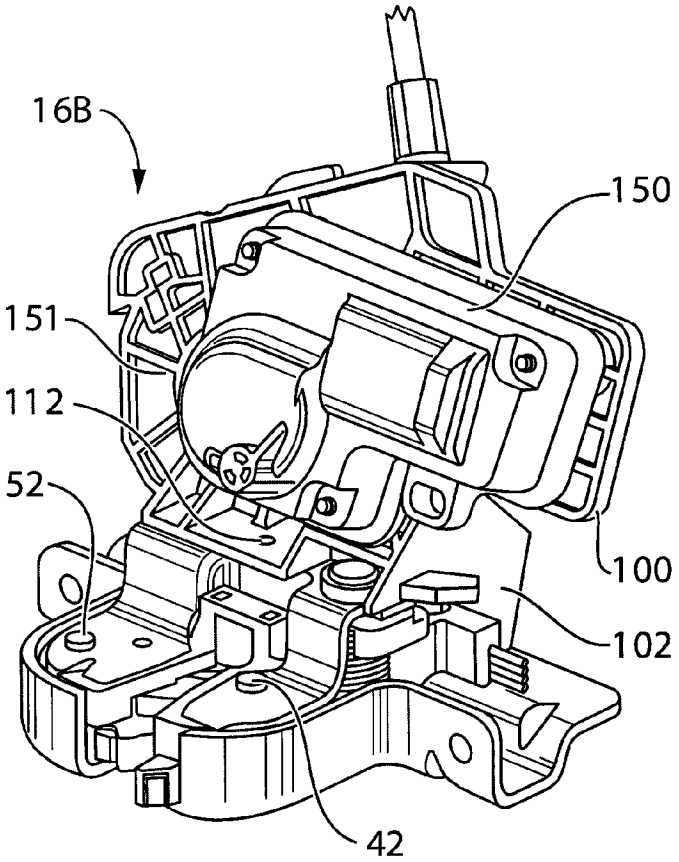
FIG. 8*b* shows a power release module mounted to the latch core of FIG. 3.

FIG. 8 shows a manually released latch module 16*a*, and FIGS. 8*b* and 9 show a power-release latch module 16*b*. A release lever 120 is pivotally mounted to a first side 118 of brain plate 100, and is movable between a "resting" position (seen in FIG. 9) and an "actuated position", where a lever arm 121 engages depending tab 68 on secondary pawl 60, thereby actuating pawl 32 to release latch 10. Release lever 120 pivots around an integrally-formed fixed axle 122 that is seated within an aperture 124. A pair of wings 126 extend out radially from axle 122, and aperture 124 includes a pair of wing-shaped cutouts 128 to permit insertion and subsequent retention of release lever 120, without the use of separate fasteners. A spring 130 biases release lever 120 towards the resting position, and is mounted around fixed axle 122. A first arm 132 is located within a slot 134 on release lever 120, and a second arm 136 is located within a slot 138 on brain plate 100. A bumper 140 is proved along a first end 142 of release lever 120, and which abuts against a sidewall 144 on brain plate 100 when the release lever 120 is in the resting position. A second end 146 of release lever is adapted to mount a release cable 148 for manual actuation. Pulling release cable 148 pivots release lever 120 to the actuated position to release latch 10, and further loads spring 130. Once tension is released on cable 148, spring 130 returns release lever 120 to the resting position.

Latch module 16*b* includes all the features described above for latch module 16*a*, in addition to the following. An actuator 150 is mounted to a second side 151 of brain plate 100. Actuator 150 is electrically connected to the vehicle's power supply (not shown), and drives an orbital cam 152, which extends through an aperture 154 (FIG. 8*a*) in brain plate 100 to first side 118. The rotational path of orbital cam 152 intersects the second end 146 of release lever 120, when in the resting position, thereby moving release 1 ever 120 to the actuated position. Once release lever 120 is in the actuated position, the latch 10 releases and the switch (described below) in core latch 12 sends the signal to the door controller in the vehicle (not shown) to stop actuator 150. As the actuator motor stops, actuator 150 back-drives, rotating orbital cam 152 in the opposite direction of actuation and comes back to the resting position. Since the release lever 120 is spring loaded against orbital cam 152, therefore, as the orbital cam 152 rotates back to the rest position the release lever also follows the orbital cam and returns back to rest position.

Figure 10:
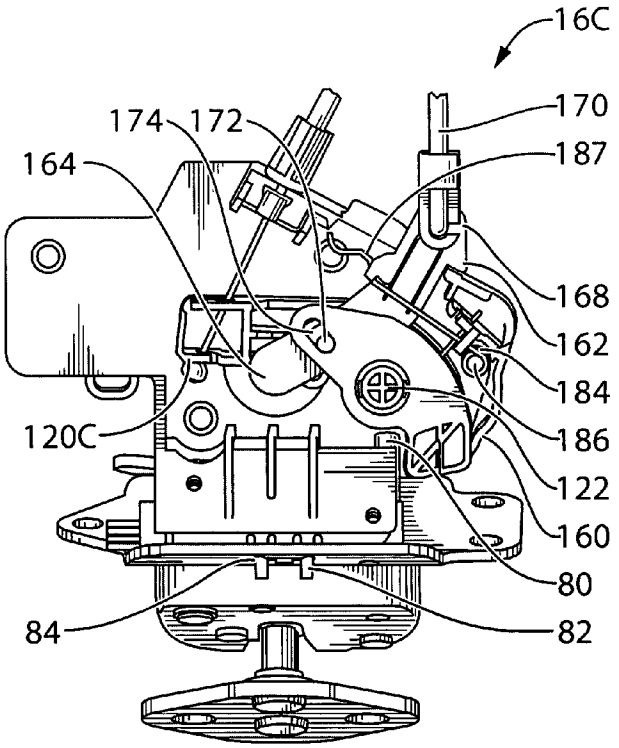
FIG. 10 is a side plan view for a power locking and unlocking module for the modular latch shown in FIG. 2.
Figure 11B:
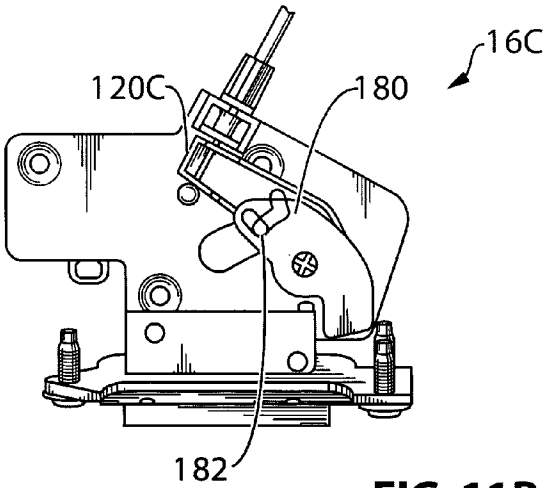
FIG. 11*b* is a side plan view for the power release module shown in FIG. 10, while locked and with the release lever actuated.
Figure 11A:
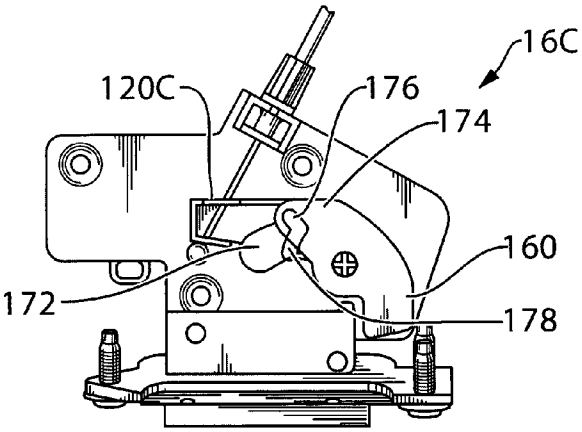
FIG. 11*a* is a side plan view for the power release module shown in FIG. 10, while locked and with the release lever at rest.
Figure 11D:
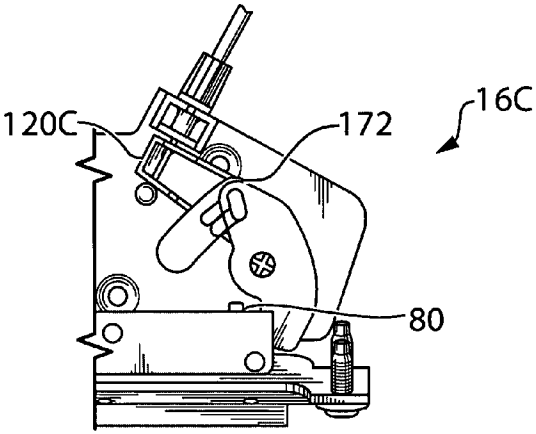
FIG. 11*d* is a side plan view for the power release module shown in FIG. 10 while unlocked and with the release lever actuated in order to release the latch.
Figure 11C:
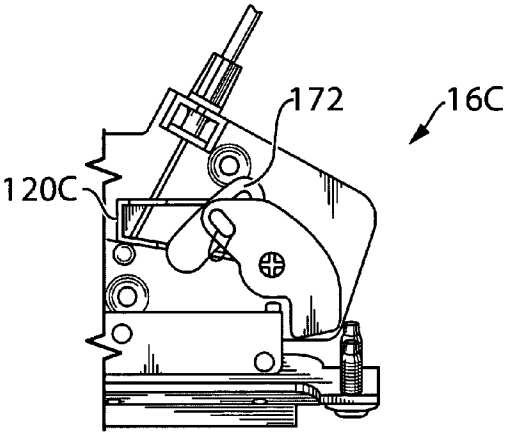
FIG. 11*e* is a side plan view for the power release module shown in FIG. 10, while unlocked and with the release lever at rest.

Referring now to FIGS. 10, and 11*a* to 11*d*, a latch module 16*c*, which provides for power locking and unlocking is shown in greater detail. FIG. 11*a* corresponds to latch module 16*c* being locked, with the release handle at rest. FIG. 11*b* corresponds to latch module 16*c* being locked, with the release handle actuated. FIG. 11*c* corresponds to latch module 16*c* being unlocked, with the release handle at rest, and FIG. 11*a* corresponds to latch module 16*c* being unlocked, with the release handle actuated to release the latch.

Latch module 16*c* includes all the features of latch modules 16*a*, in addition to the following features described below. With latch module 16*c*, release lever 120 is replaced with release lever 120*c* and auxiliary release lever 160, which is pivotally and coaxially mounted around axle 122 on release lever 120*c*. Auxiliary release lever 160 is operable to actuate the depending tab 68 on secondary pawl 60. A lock and unlock lever 162 acts as the lock and unlock output shaft of the actuator 150*c*. Actuator 150*c* includes a reversible DC motor, and engaging actuator 150*c* moves locking lever 162 between a locked position (FIG. 11*a* and unlocked position (FIG. 11*c*). A second end 168 of locking lever 162 is adapted to receive a lock cable 170 for manual locking and unlocking (FIG. 10). A pin 172 extends through a slot 174 in locking lever 162, slot 176 in auxiliary release lever 160, and also in an L-shaped slot 178 in release lever 120*c*. Moving locking lever 162 into the unlocked position (FIG. 11*c*) slides pin 172 into an arm 180 of L-shaped slot 178 (best seen in FIG. 11*b*), thereby kinematically coupling release lever 120*c* and auxiliary release lever 160. Thus, actuating release lever 120*c* also actuates auxiliary release lever 160 to engage secondary pawl 60. Moving locking lever 162 into the locked position moves pin 172 into arm 182 of L-shaped slot 178, thereby kinematically decoupling release lever 120*c* and auxiliary release lever 160. Thus, actuating release lever 120C does not actuate auxiliary release lever 160. A spring 184 that is located around a post 186 in brain plate 100, and has an arm 187 hooked into locking lever 162 biases locking lever 162 towards the nearest of locked and unlocked positions.

Figure 12:
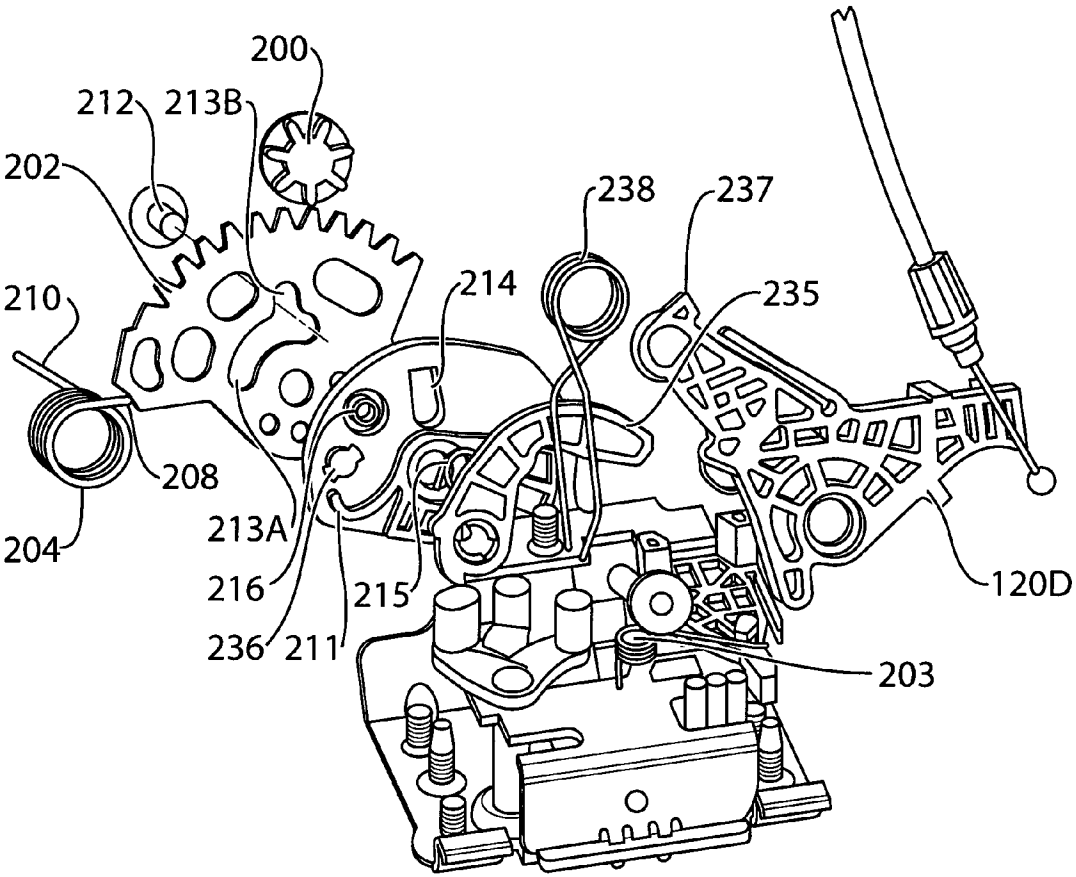
FIG. 12 is an exploded view for a power cinching and release module for the modular latch shown in FIG. 2.
Figure 13:
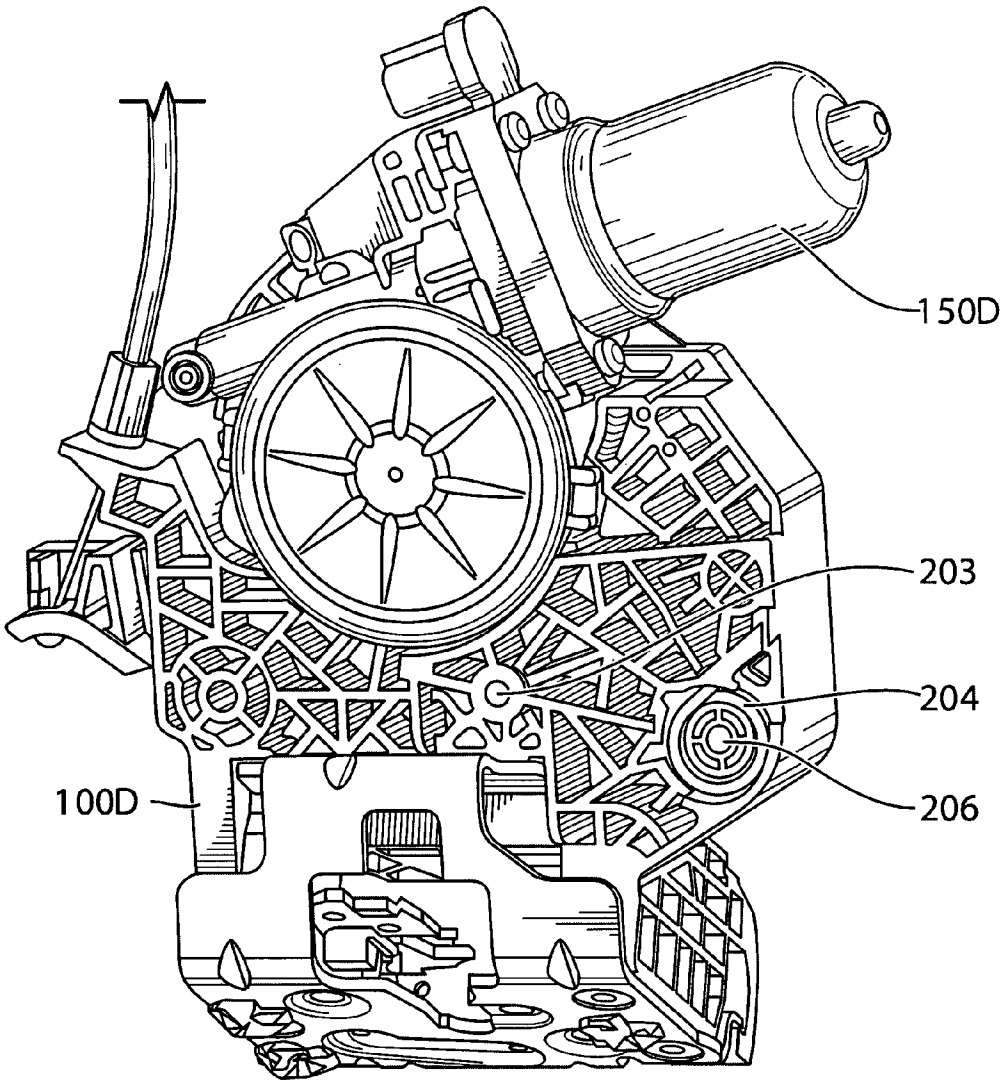
FIG. 13 is a perspective view for the power cinching and release module for the modular latch shown in FIG. 12.
Figure 14:
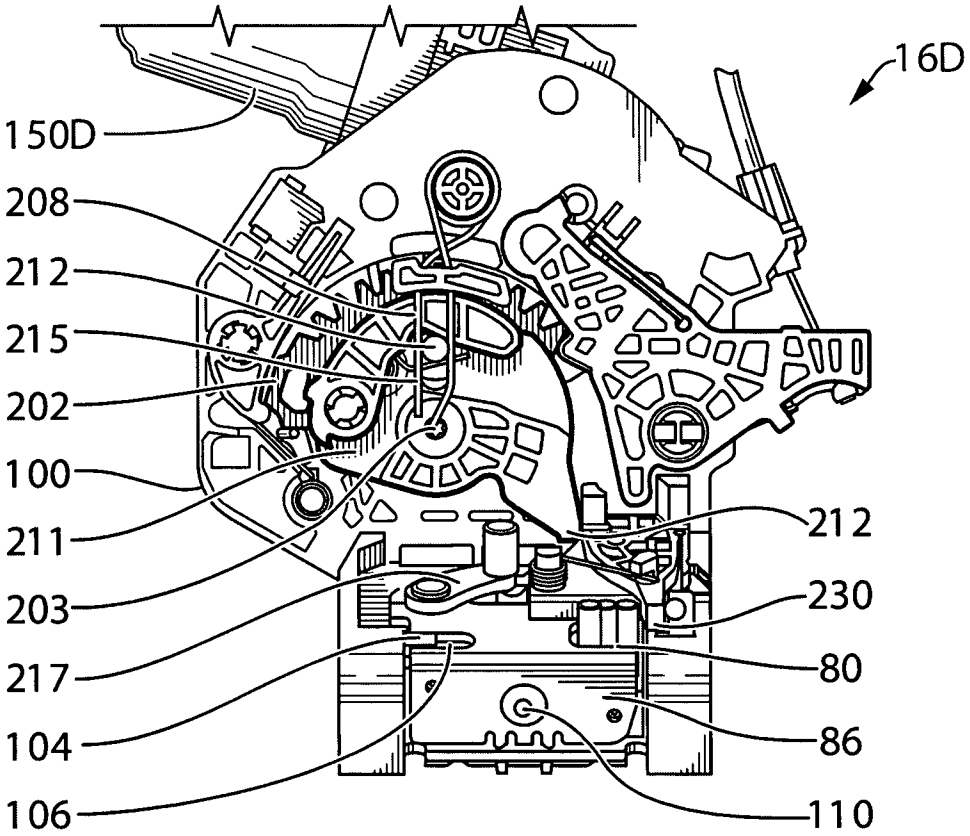
FIG. 14 is a side plan view for a power cinching and release module in the resting position for the modular latch shown in FIG. 12.

Referring now to FIGS. 12-17, a latch module 16*d*, which provides for power cinching and releasing is shown in greater detail. FIG. 12 shows an exploded view of latch module 16*d* with the brain plate 100*d* removed. FIG. 13 shows a perspective view of the front of latch module 16*d*, including brain plate 100*d*. FIG. 14 shows latch module 16*d* in a resting state. Latch module 16*d* includes an actuator 150*d*, having a spur 200 mesh with the teeth on a sector gear 202 on the opposite side of brain plate 100*d*. Sector gear 202 rotates on an axle 203 between a resting position (FIG. 14), a cinched position (FIG. 15*a*), and a power release position (FIG. 15*b*). Once the cinch and the release operation is complete as required, the switches in the latch send the signal to the door controller in the vehicle which powers the actuator in the opposite direction to the operation last performed which brings the sector and the complete gear train back to the home or resting position.

A sector arm 211 is coaxially mounted over sector gear 202 on axle 203 and operable to pivot independently of sector gear 202. A pin 212 extends through a slot 213 in sector gear 202 and a straight slot 214 in sector arm 211. Slot 213 in sector gear 202 has a generally arcuate portion 213*a*, and a leg portion 213*b* that extends outwards. A spring 215, mounted around a post 216 on sector arm 211 biases pin 212 to sit leg portion 213*b*. Thus, under normal operating conditions, the rotational movements of sector gear 202 and sector arm 211 are coupled, and the two pivot together in tandem.

Latch module 16*d* uses a four-bar cinching assembly to transfer the loading force from sector gear 202 to ratchet 30. As is best seen in FIG. 16, when sector gear 202 moves to the cinched position (FIG. 15*a*), sector arm 211 pivots a cinch lever 217 from a "resting" position (FIG. 15*b*) to a "cinched" position (FIG. 15*a*). Referring to FIG. 16, cinch lever 217 is fixedly mounted to a cinch axle 218 that is rotatably mounted within core latch 12. A cam arm 219 is fixedly mounted around cinch axle 218. A link 220 is pivotally attached at a first end 222 to cam arm 219, and at a second end 224 to ratchet 30. Rotating cinch lever 217 rotates ratchet 30 in an opposite direction. Thus, rotating sector gear 202 to the cinched position rotates ratchet 30 to its engaged position. Cinch lever 217, cam arm 219, link 220 and ratchet 30 form a four-bar assembly that ensures the input load provided by actuator 150*d* remains steady while the output rotational load of ratchet 30 matches the resistance load profile of the gate or door being cinched (generally an exponential profile). By varying the lengths of the different components of the four-bar mechanism, different resistance load profiles can be achieved. A spring 224 is coiled around cinch axle 218 (see FIGS. 18*a* and 18*b*). Spring 224 has a pair of arms 225 that are located in slots 227 in housing 18, and which prevent spring 224 from rotating. Thus rotating cinch axle 218 tightens the spring 224 around the axle so that when ratchet 30 is engaged, spring 224 returns cinch lever 217 and four-bar mechanism to its resting position.

Figure 15B:
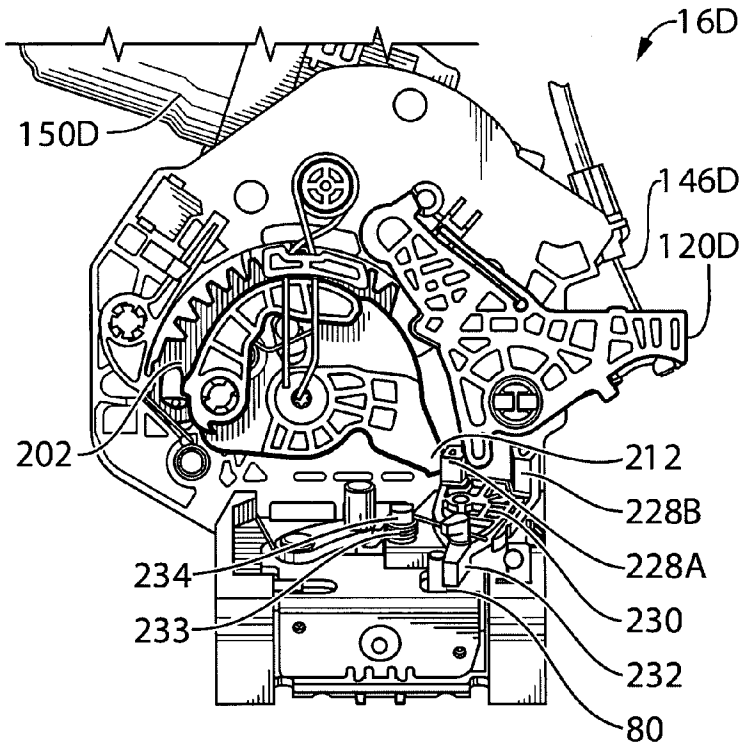
FIG. 15*b* is a side plan view for a power cinching and release module in the power release position for the modular latch shown in FIG. 12.
Figure 15A:
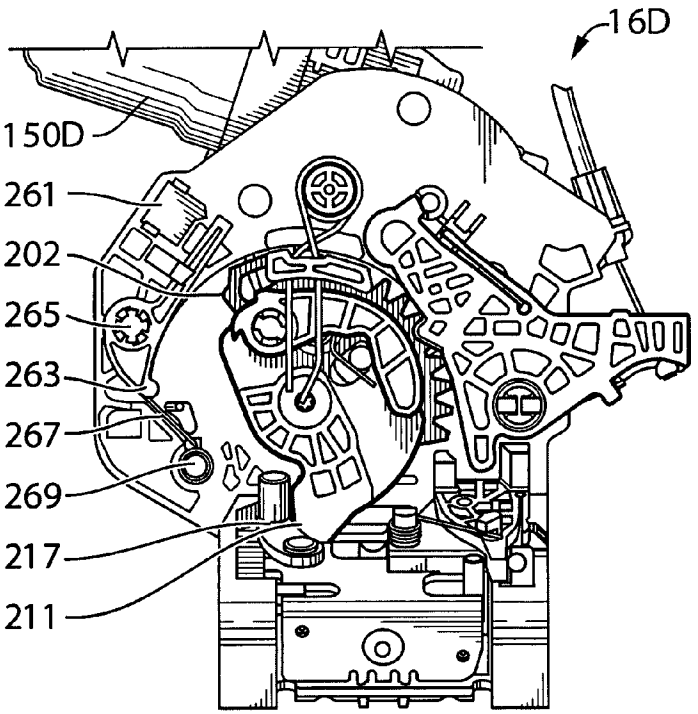
FIG. 15*a* is a side plan view for a power cinching and release module in the cinched position for the modular latch shown in FIG. 12.
Figure 16:
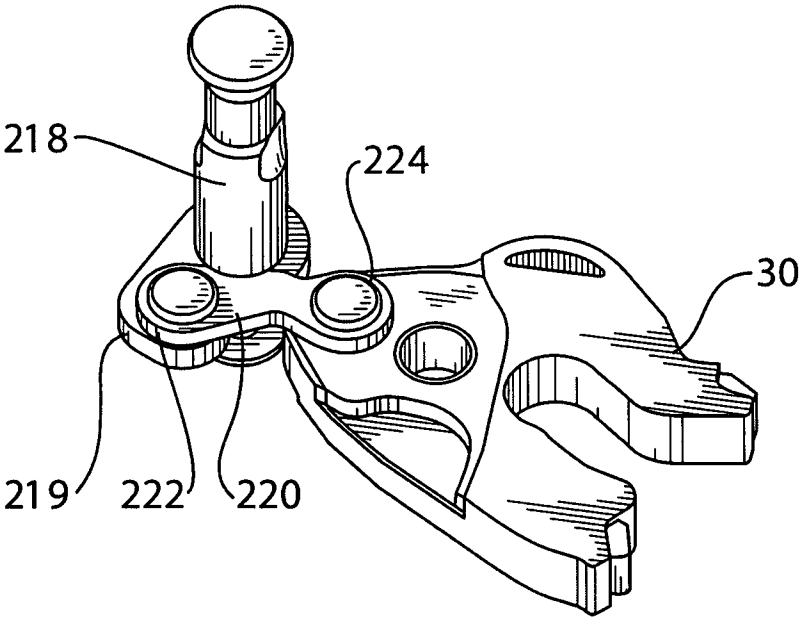
FIG. 16 shows an isolated view of a power-cinching ratchet for the latch core shown in FIG. 12.

In FIG. 15*b*, power release is provided by reversibly engaging actuator 150*d*, which rotates sector gear 202 and sector arm 211 in the opposite direction (in the illustrated embodiment, sector gear 202 rotates counter clockwise). Sector arm 211 engages a tab 228*a* on an auxiliary release lever 230, which is pivotally mounted to a portion of brain plate 100 that is substantially parallel to substrate 78 on cover plate 76. An arm 232 on auxiliary release lever 230 pivots and actuates depending tab 76 on secondary pawl 60 to actuate secondary pawl 60, and releases the latch. A spring 233 is mounted around a post 234, which biases auxiliary release lever 230 to a resting position away from tab 232 of secondary pawl 60. Once the release operation is complete, the switches in the latch send the signal to the door controller in the vehicle which powers the actuator in the opposite direction to the release direction and brings the sector and the complete gear train back to the home, or resting, position.

Manual release is provided by actuating the release cable 146*d*, which pivots release lever 120*d*. A tab 226 on release lever 120*d* abuts against a tab 228*b* on an auxiliary release lever 230, which then actuates the depending tab 68 on secondary pawl 60 to release the latch. As release cable 146 returns to its resting position, release lever 230 returns to its resting position, with tab 226 located between tabs 228*a* and 228*b* under the load from auxiliary release lever 230 and spring 233.

Figure 17:
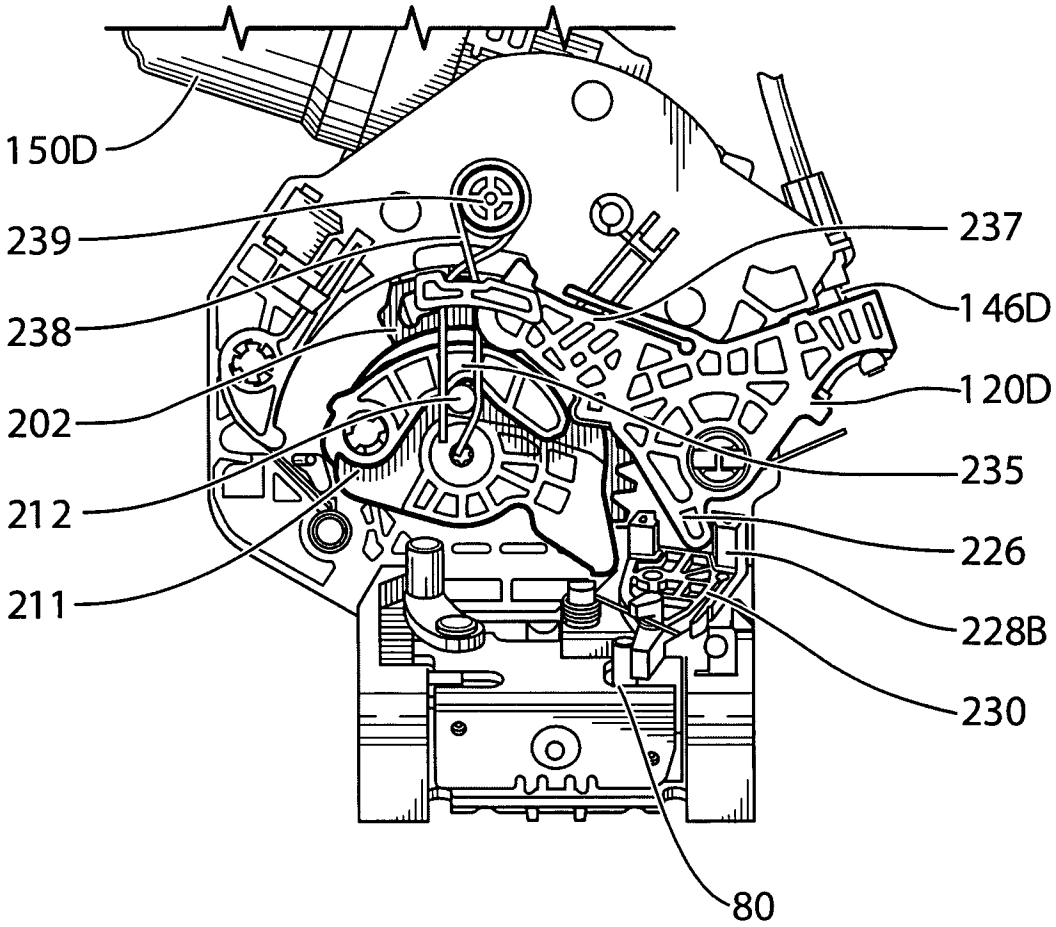
FIG. 17 is a side plan view for a power cinching and release module in the manual reset position for the modular latch shown in FIG. 12.

Electrical power may fail during a power cinch or power release actuation, leaving sector gear 202 out of its resting position, and ratchet 30 located midway between positions—potentially hindering future operation of the latch. To prevent this, a reset function is provided by manually engaging release lever 120*d*. Referring now to FIG. 17, a reset lever 235 is pivotally mounted around a post 236 on sector arm 211, and rests against pin 212. During normal power operations, reset lever 235 remains in place, rotating around axle 203 with sector arm 211. However, when release lever 120*d* is pivoted for manual release, an arm 237 on the lever engages the reset lever 235, pivoting it downwards. As reset lever 235 pivots, it forces pin 212 down from slot 213*b* into slot 213*b* (FIG. 12). With pin 212 in slot 213*a*, sector gear 202 and sector arm 211 are decoupled. Thus sector arm 211 can return to its resting position without needing to backdrive actuator 150*d*. Once release lever 120*d* is released, a spring 238, mounted on a post 239 on brain plate 100*d* returns sector arm 211 to the correct resting position relative to sector gear 202. Pin 212 moves back along arcuate slot 213*a* to a position under slot 213*b*. Spring 215 then returns pin 212 to slot 213*b*, re-coupling sector gear 202 and sector arm 211 once the latch is powered again. A return spring 204 is mounted to a post 206 of brain plate 100*d*, and has an arm 208 that extends to bias sector gear 202 to its return, or at rest, position. Tail end 210 of spring 204 is anchored to brain plate 100*d*.

Figure 1B:
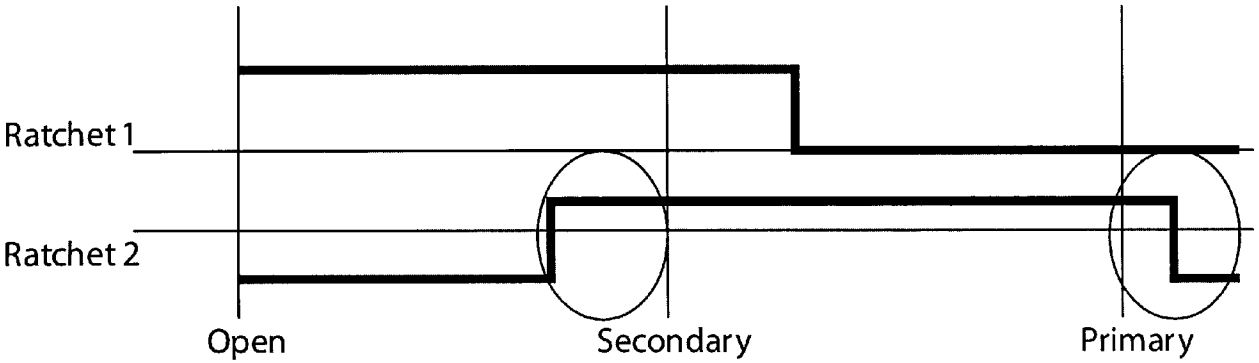
FIG. 1B (PRIOR ART)

For power cinching and release, the actuator needs to know the location of the striker 35 within the fishmouth 34, position of the ratchet (i.e., primary engagement, secondary engagement, or release position) and pawl (engaged or disengaged), in order to know when to start, and how long to drive actuator 150*d*. Typical prior art latches used a switch that is triggered by the pivotal movement of the ratchet (either on an external edge of the ratchet, or on a linked axial cam), to indicate that the striker is engaged and that power cinching should begin (as shown in FIGS. 1*a* and 1*b*). In other words, the switch indicated only when the ratchet was closing, not whether striker 35 was located within the fishmouth. This limitation could lead to scenarios where the gate was resting on the striker 35, but not actually being held in place by the ratchet. In contrast, the present switching strategy reports on the position of the striker 35 directly.

Figure 18B:
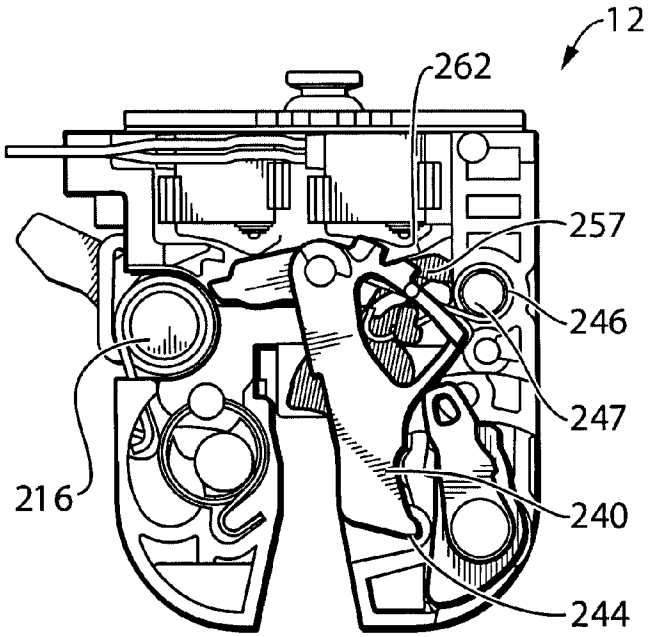
FIG. 18*b* shows a top plan view of the latch core shown in FIG. 3, featuring a striker switching assembly in the actuated position.
Figure 18A:
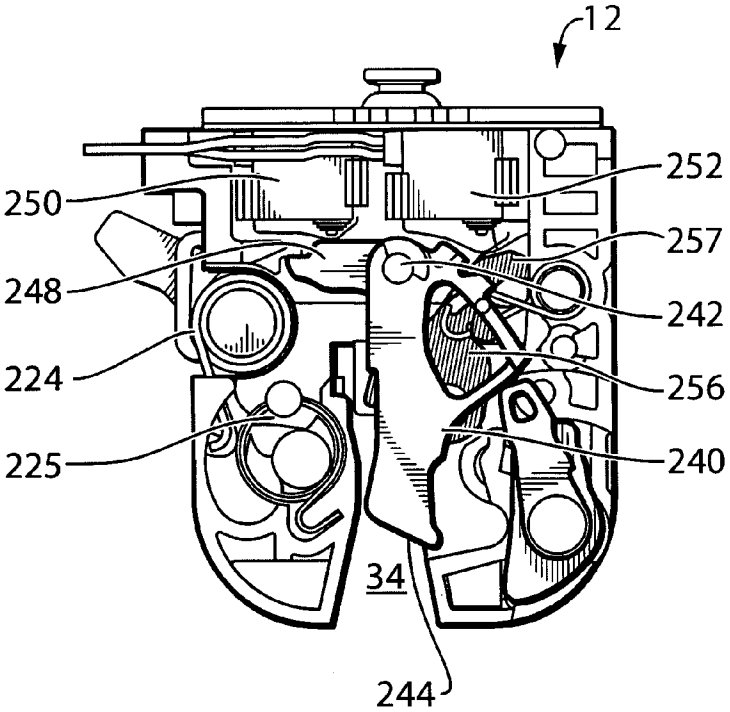
FIG. 18*a* shows a top plan view of the latch core shown in FIG. 3, featuring a striker switching assembly in the resting position.
Figure 20:
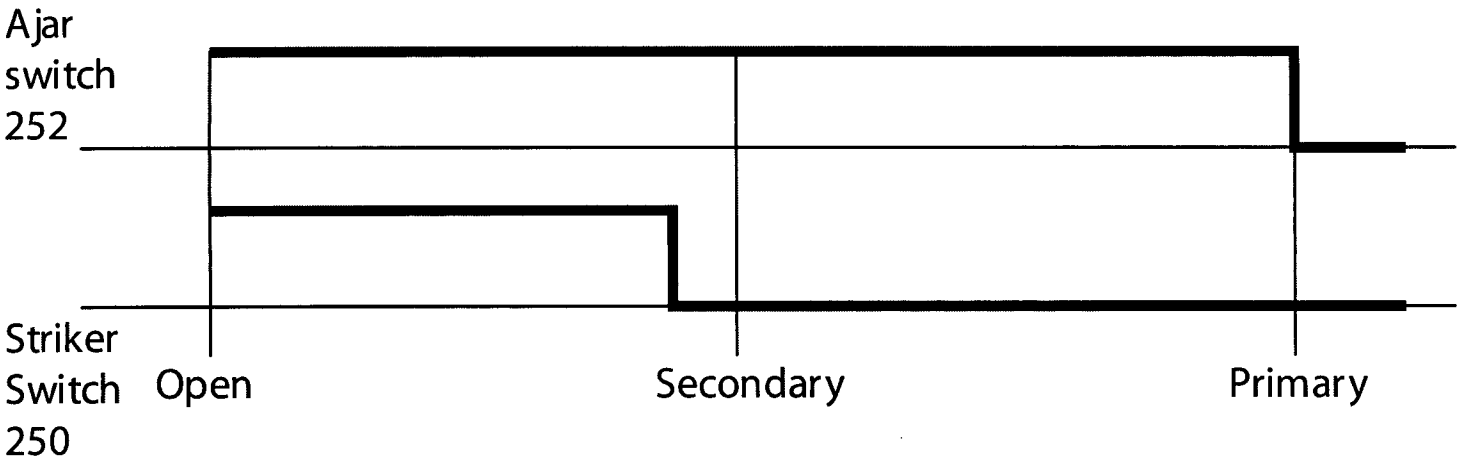
FIG. 20 shows a table presenting a switching strategy in accordance with an aspect of the invention.

Referring now to FIGS. 18*a* and 18*b*, a portion of common latch 12 is shown in greater detail. A striker lever 240 is pivotally mounted around an axle 242 that is located within housing 18. Striker lever 240 is movable between a resting position (FIG. 18*a*), where a first end 244 extends into fishmouth 34, and an actuated position (FIG. 18*b*), where first end 244 is rotated out of fishmouth 34 by the striker 35 (FIGS. 19*b*-19*b*). A spring 246, that is mounted around a post 247 biases striker lever 240 towards the resting position. Thus, as soon as a striker 35 enters fishmouth 34, striker lever 240 moves to the actuated position, and as soon as it is withdrawn, striker lever 240 moves to the released position. A switch arm 248 on striker lever 240 triggers a striker switch 250 that is mounted within core latch 12. When striker lever 240 is in the resting position, switch arm 248 engages a striker switch 250 (ON state). When striker lever 240 is rotated to the actuated position, switch arm 248 rotates away from switch 250, disengaging it (OFF state). It will thus be apparent that striker switch 250 detects the presence or absence of striker 35 within fishmouth 34 (as can be seen in the switch strategy table in FIG. 20).

Figure 6:
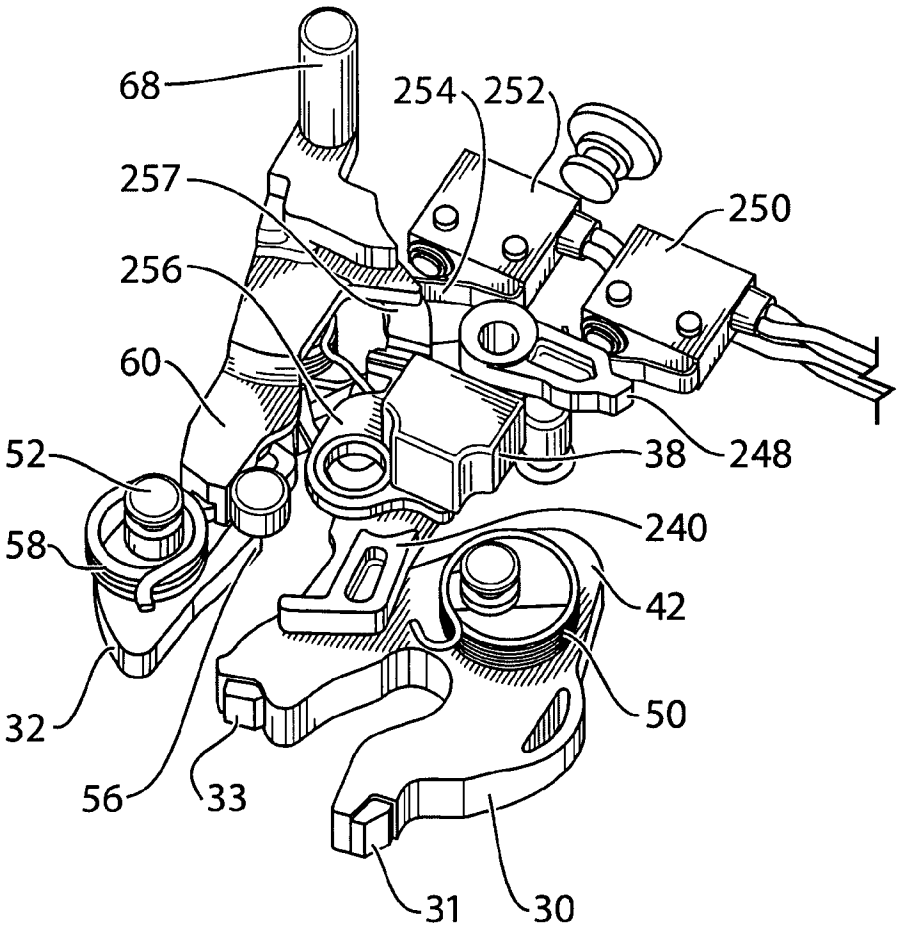
FIG. 6 is a detailed exploded view of the latch core components shown in FIG. 3.
Figure 19C:
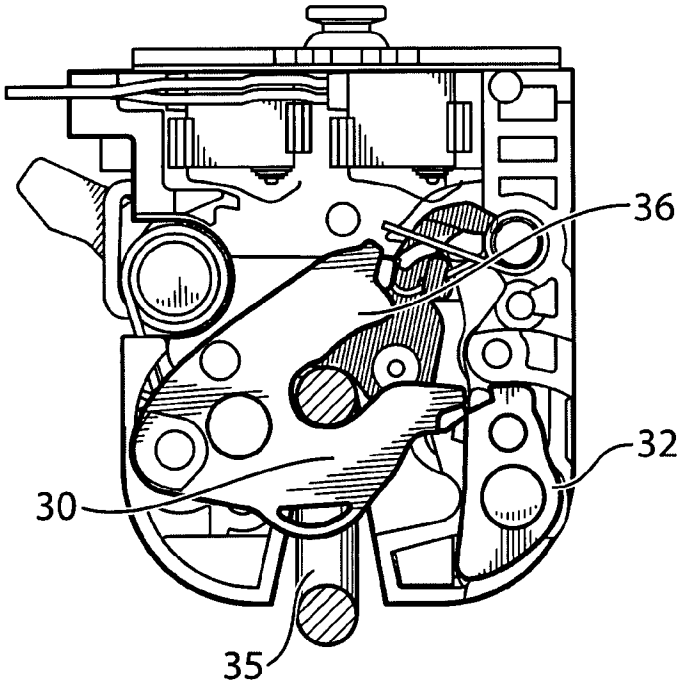
FIG. 19*c* shows a top plan view of the latch core shown in FIG. 3, featuring a striker entering a latch having the ratchet moving towards the primary engagement position.

An ajar switch 252 is also provided within core latch 12. Ajar switch 252 is actuated by a switch arm 254 on secondary pawl 60 (FIG. 6). When secondary pawl 60 is resting, switch arm 254 is displaced away from ajar switch 252. When secondary pawl 60 is actuated, switch arm 254 engages ajar switch 252. In addition, a striker ajar lever 256 is also used engage ajar switch 252 via a switch arm 257. Striker ajar lever 256 also has an ajar arm 258 extending into fishmouth 34, although not as far as striker lever 240. Thus, striker ajar lever 256 is pivoted by striker 35 much closer to the primary engagement position than striker lever 240. Striker ajar lever 256 is pivotally mounted around an axle 260 in substrate 20, and pivots between an engaged position (FIG. 19*a*, 19*b*) where it engages ajar switch 252, and a disengaged position (FIG. 19*c*, 19*d*), where it is disengaged with ajar switch 252. In order to eliminate the transition zone of ajar switch 252, switch arm 257 on striker ajar lever 256 and switch arm 254 on secondary pawl 60 move in parallel, overlapping paths (best seen in FIG. 6). In order to minimize slippage off the switch blade, a living blade 262 is formed from substrate 20 that extends into compartment 28 so that it can abut against either of switch arms 254 and 257. Living blade 262 is molded thin enough as to provide a resilient blade that can be moved by either switch arm to trigger switch 252. Living blade 262 is sized as to provide a larger engagement profile than ajar switch 252.

Switch arm 254 on secondary pawl 60, by itself, will provide a control logic identical to the prior art pawl switch described in FIG. 1. Namely, it shows an ON state while the ratchet is open. When the ratchet 30 moves to the secondary engagement position, it disengages from ajar switch 252, briefly re-engages as the ratchet 30 moves from the secondary engagement position to the primary engagement position, where it disengages once again. However, when combined with switch actuation provided by striker ajar lever 256, the state of ajar switch 252 matches the switching strategy described in FIG. 20. Ajar switch 252 is in the ON position while the ratchet moves from the Open position to the secondary engagement position. Striker ajar lever 256 maintains ajar switch 252 in the ON position even as the pawl 32 disengages and moves between secondary and primary engagement positions. Finally, as striker 35 reaches overslam bumper 38 at the end of fishmouth 35, it actuates striker ajar lever 256 to release striker switch 252, just as the ratchet is entering the primary engagement position. With both striker arm 254 of secondary pawl and switch arm 257 displaced away from ajar switch 252, it switches to the OFF state.

The switching strategy described herein may tend to avoid problems found in earlier latches. Unlike the switching strategy of FIG. 1*a*, there is no indeterminate condition caused when the ratchet moves between the secondary engagement position and the primary engagement position. Furthermore, the actuator knows exactly how long to apply cinching power, unlike the switching strategy described in FIG. 1*b*. Striker switch 250 moves to the OFF state when the striker 35 enters fishmouth 34 this provides the indication to activate the actuator 150*d*. Ajar switch 252 switches to OFF when ratchet 30 moves into the primary engagement position. Thus, the actuator 150*d* turns on at the correct moment, and off at the correct movement, with minimal overlap. Furthermore, this switching strategy is more robust and easier to implement than prior art switching strategies.

Referring back to FIG. 15*a*, an optional sector switch 261 is mounted into brain plate 100*d*. For power cinching modules 16*d* that do include a sector switch 261, a switch lever 263 is pivotally mounted around a post 265 in brain plate 100*d*, and is operable to engage or disengage sector switch 261. A spring 267, mounted around a post 269 in brain plate 100*d* biases switch lever 263 to engage switch 261. The rotation of sector gear 202 out of its resting position moves switch lever 263 to disengage from sector switch 261. The electronic control unit in the vehicle (not shown) can simply reverse actuator 150*d* until sector switch 261 is re-engaged. This ensures that the gear train is always in the same spot after both cinching and power release when using actuator 150*d* for both functions, improving the quick release operation.

Latches may fail to open when an unusually heavy load is applied to the closure panel. Lift gates are particularly problematic, as they can easily be weighed down with snow or ice, and a greater force is required to lift them. If the striker does not immediately clear the fishmouth, the pawl might drop back into place. A snow load lever can help obviate the problem. Referring now to FIGS. 21*a*-21*d*, a snow load assembly is shown during a release cycle to help obviate the problem. FIG. 21*a* shows compartment 86 on latch core 12, when normally latched. A snow load lever 264 is pivotally mounted around a post 266 that extends from base plate 18 into compartment 86. Snow load lever 264 includes a pawl arm 268, ending in a hook 270, and a release arm 272. A spring 274 is coiled around snow load lever 264, and biases it towards secondary pawl 60. Snow load lever 264 is movable between a "resting position" (shown in FIG. 21*a*), and an 'actuate position' (FIG. 21*b*), where it pivots to lock secondary pawl 60.

Figure 21B:
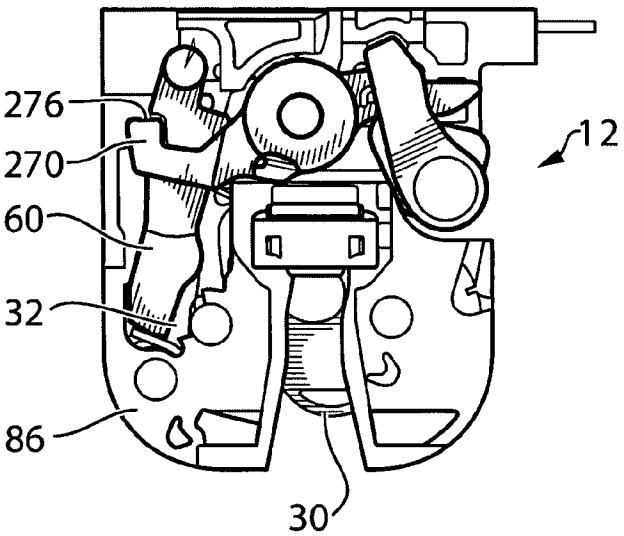
FIG. 21*b* shows the bottom plan view of the latch core shown in FIG. 3, having a snowload assembly in the engaged position.
Figure 21A:
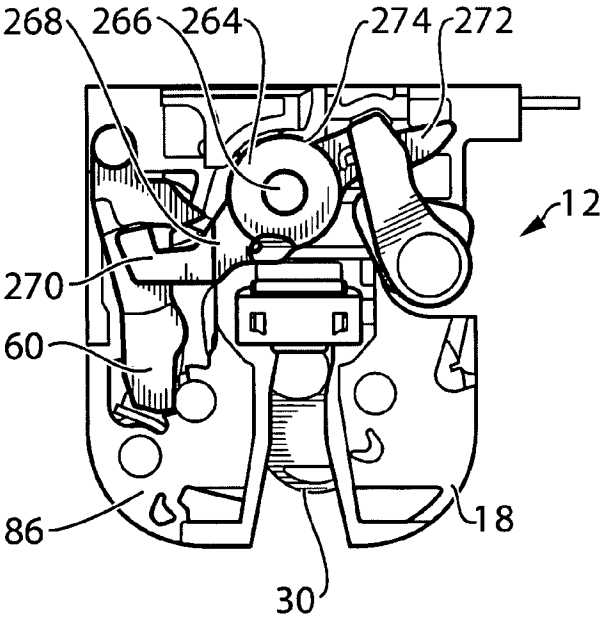
FIG. 21*a* shows the bottom plan view of the latch core shown in FIG. 3, having a snowload assembly in the resting position.

FIG. 21*b* shows compartment 86 on latch core 12, when pawl 32 is released, but ratchet 30 does not move due to a snowload condition. When pawl 32 is released, secondary pawl 60 rotates in an opposite sense. As secondary pawl 60 rotates, a shoulder 276 on the secondary pawl 60 catches hook 270. Secondary pawl is now prevented from rotating back to the resting position, leaving pawl 32 actuated.

Figure 21D:
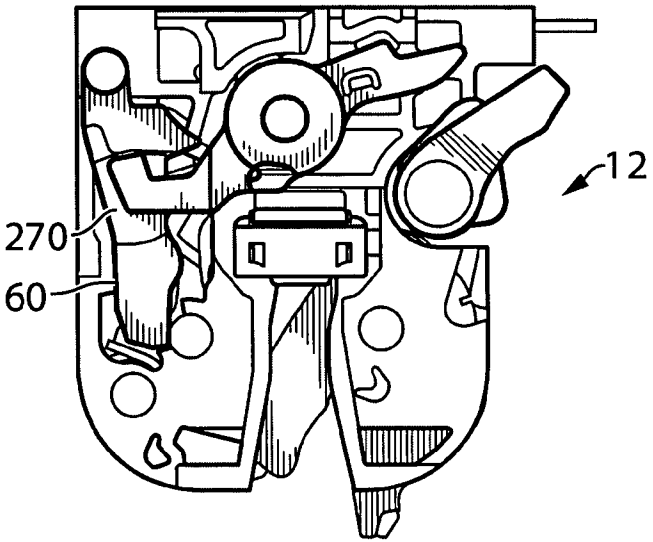
FIG. 21*d* shows the bottom plan view of the latch core shown in FIG. 3, having a snowload assembly where the ratchet has been released position.
Figure 21C:
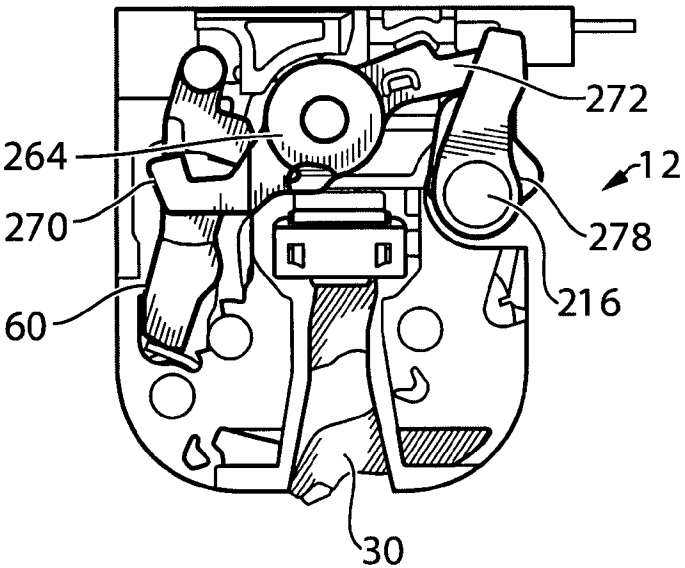
FIG. 21*c* shows the bottom plan view of the latch core shown in FIG. 3, having a snowload assembly being manually reset.
Figure 22A:
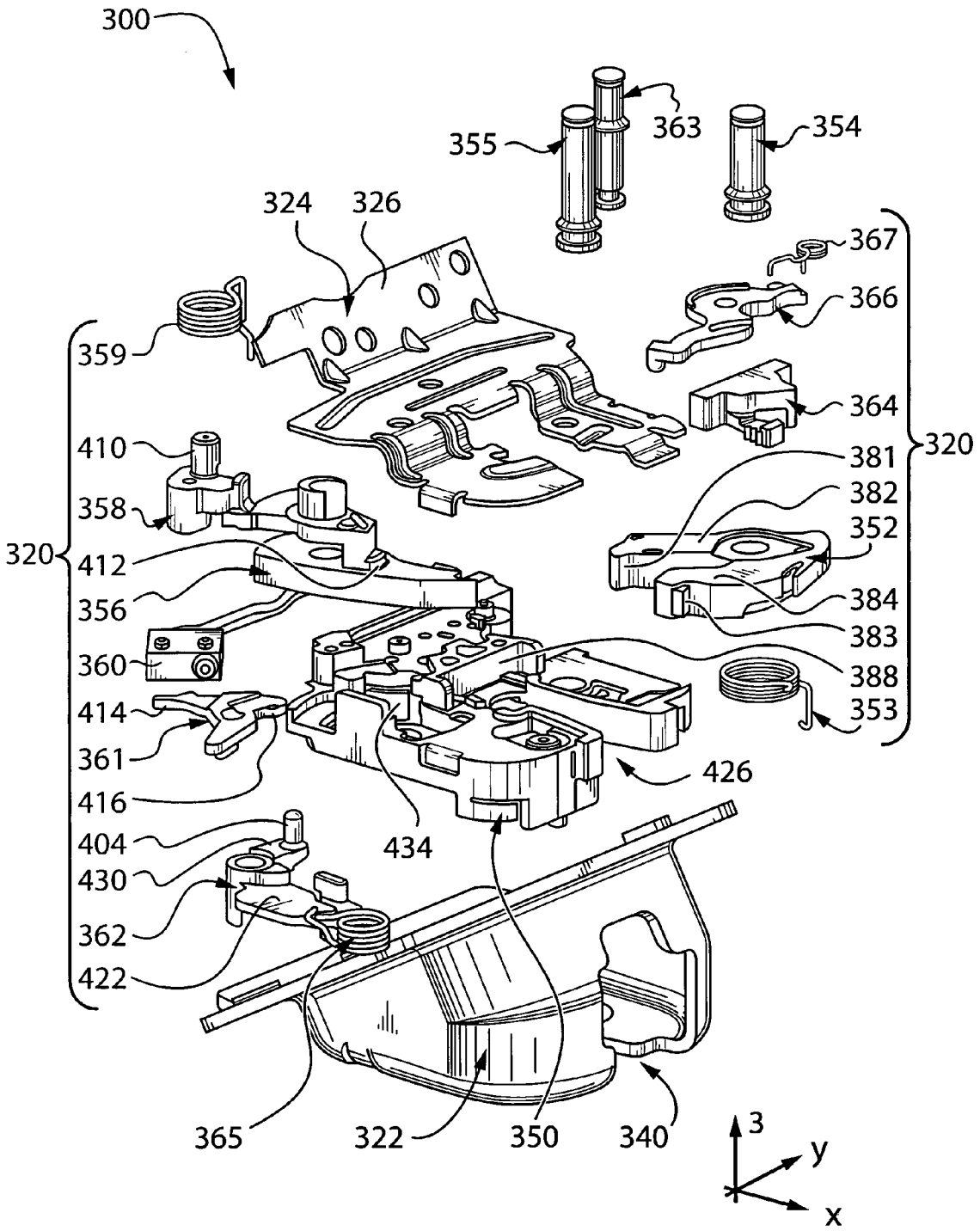
FIG. 22*a* shows an exploded view of an alternate door latch assembly to that of FIG. 3.
Figure 22B:
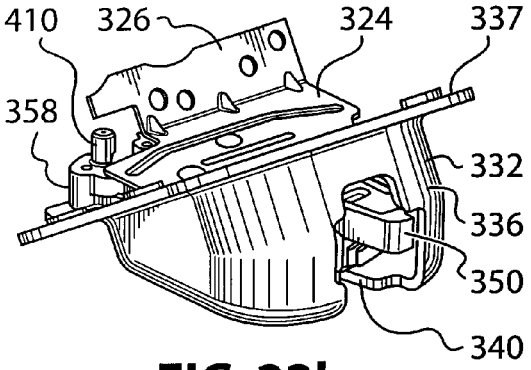
FIG. 22*b* is an assembled isometric view of the door latch assembly of FIG. 22*a;*
Figure 22C:
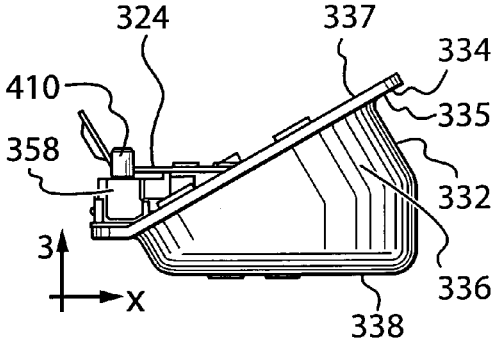
FIG. 22*c* shows a side view of the latch assembly of FIG. 22*a;*
Figure 22D:
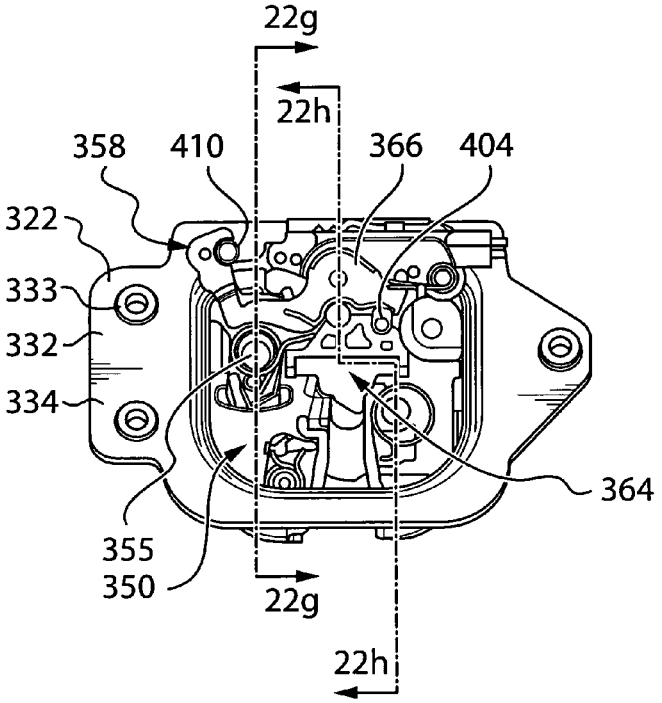
FIG. 22*d* shows a view of the latch assembly of FIG. 22*a* taken on arrow '22*d*' of FIG. 22*c* with the top backing plate removed to expose the latch core.
Figure 22F:
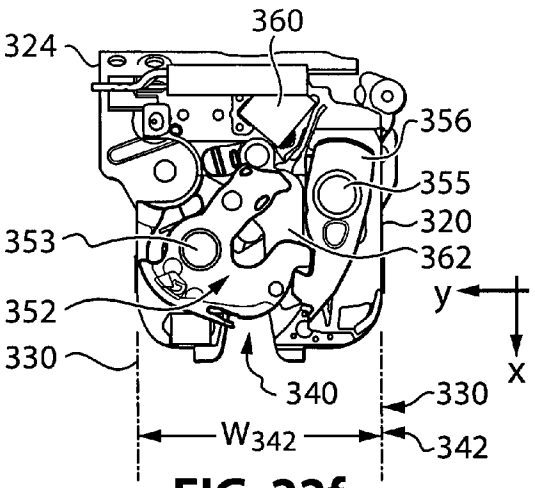
FIG. 22*f* shows the latch core of FIG. 22*d* from the underside.
Figure 22H:
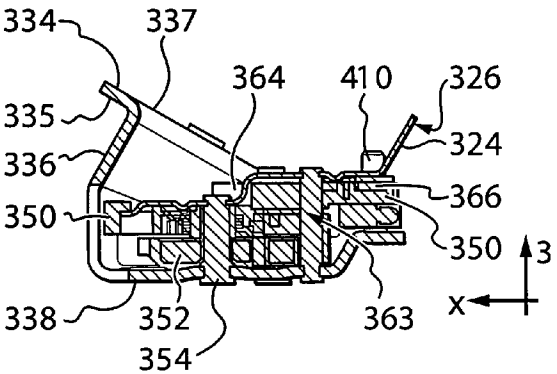
FIG. 22*h* is a section of the latch assembly of FIG. 22*d* taken on '22*h*-22*h'*.
Figure 22E:
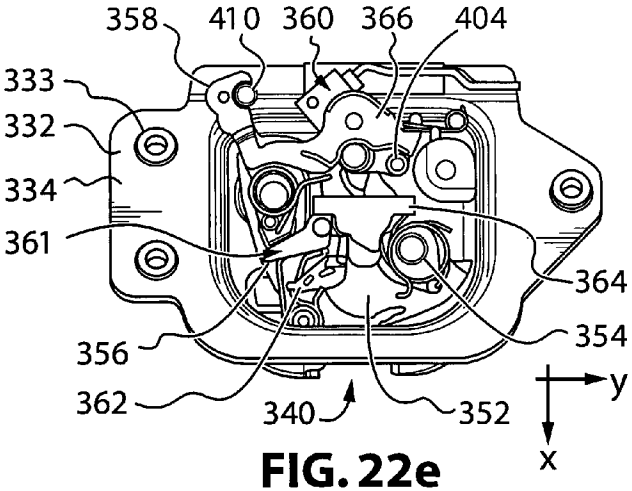
FIG. 22*e* shows the latch assembly of FIG. 22*d* with the internal housing plate also removed.
Figure 22G:
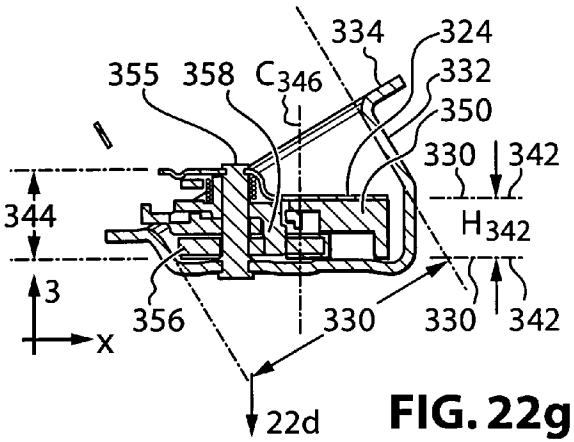
FIG. 22*g* is a section of the latch assembly of FIG. 22*d* taken on '22*g*-22*g'*.
Figure 22I:
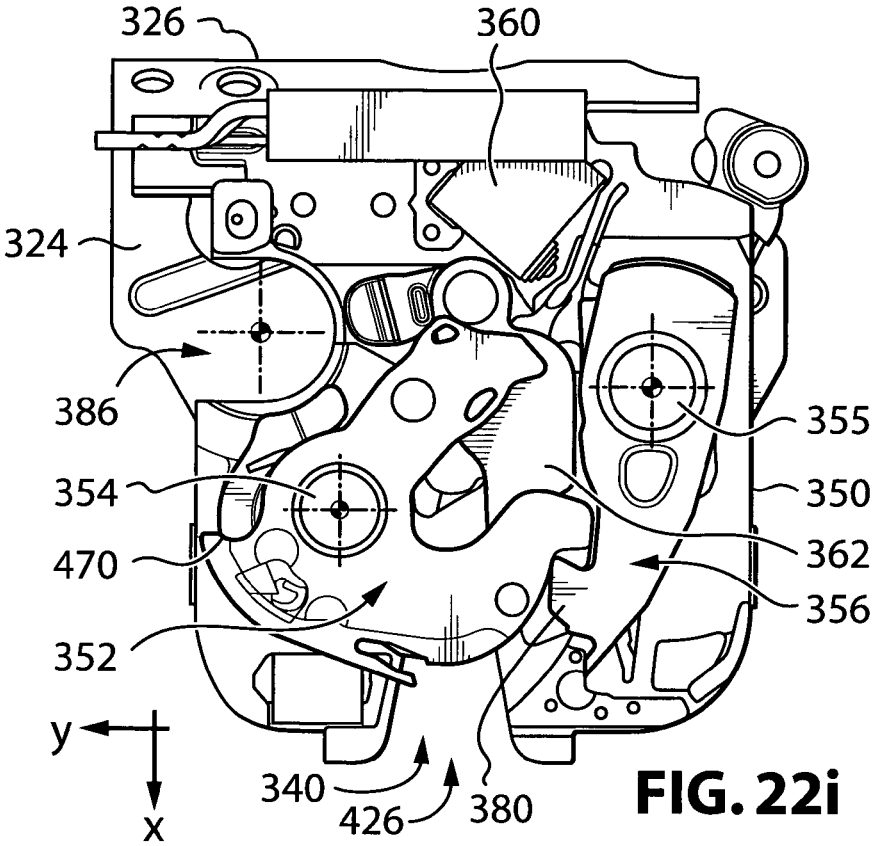
FIG. 22*i* is an enlargement of FIG. 22*f;*
Figure 23H:
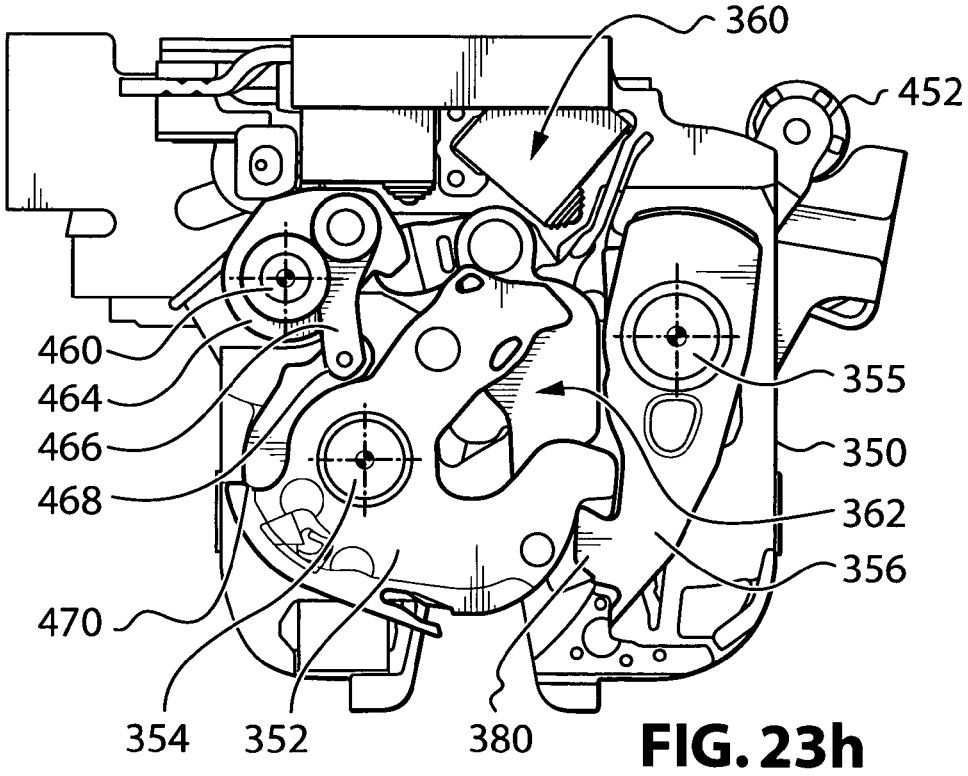
FIG. 23*h* shows the latch core of FIG. 23*d* from the underside.
Figure 23A:
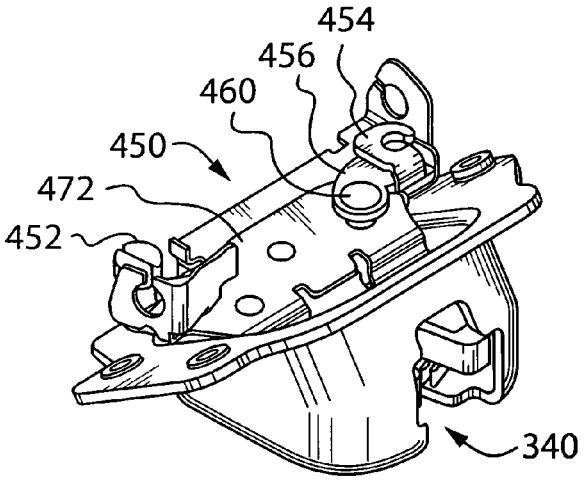
FIG. 23*a* is an isometric view of an alternate embodiment of latch assembly to that of FIG. 22*a*, having a power cinching input.
Figure 23B:
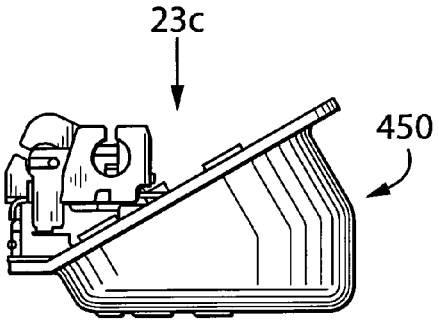
FIG. 23*b* is a side view of the latch assembly of FIG. 23*a;*
Figure 23C:
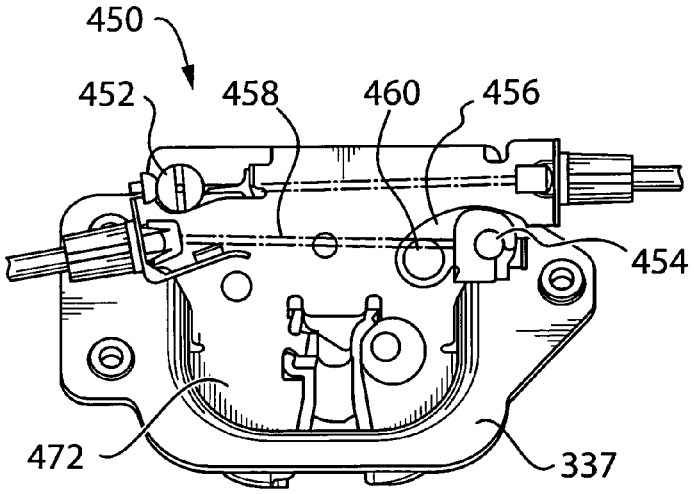
FIG. 23*c* is a top view of the latch assembly of FIG. 23*b* taken on arrow '23*c'*.
Figure 23D:
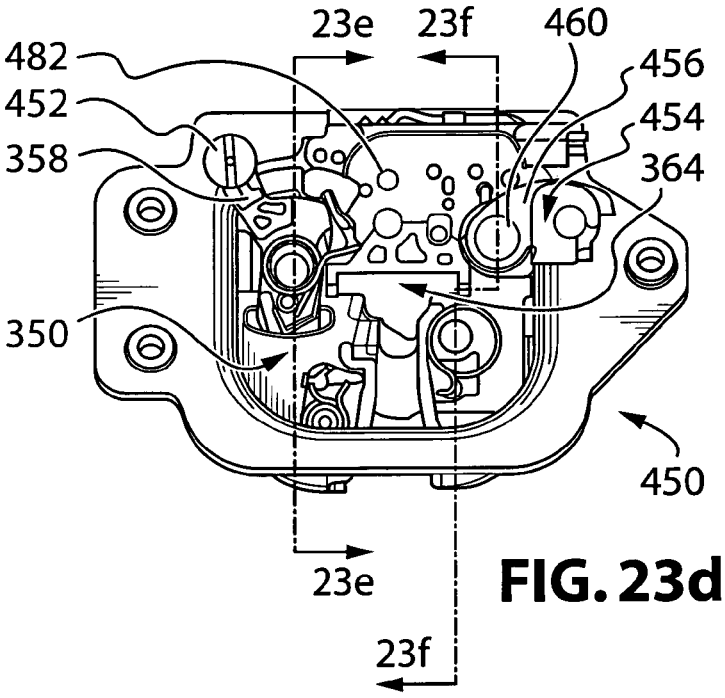
FIG. 23*d* shows the latch assembly of FIG. 23*c* with the top cover back plate removed to reveal the latch core.
Figure 23E:
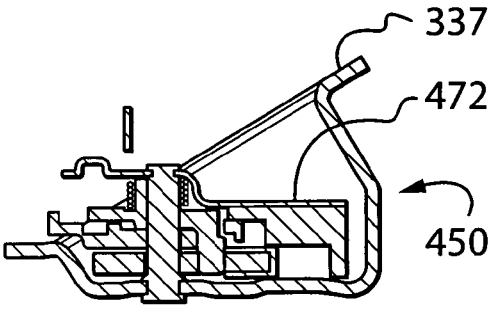
FIG. 23*e* shows the latch assembly of FIG. 23*d* on section '23*e*-23*e'*.
Figure 23F:
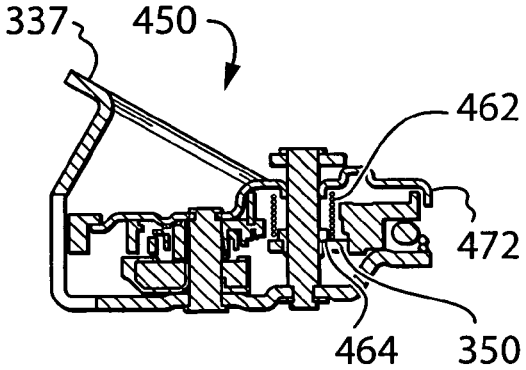
FIG. 23*f* shows the latch assembly of FIG. 23*d* on section '23*f*-23*f*'.
Figure 23G:
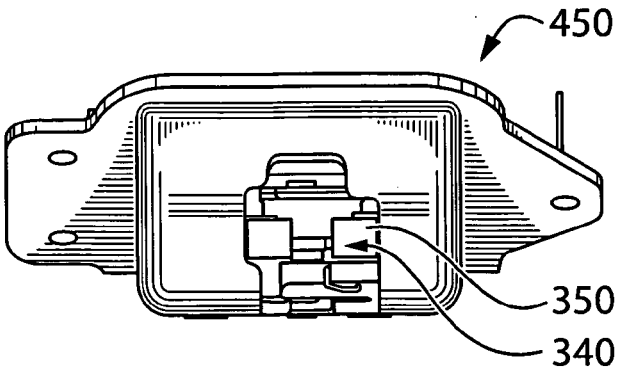
FIG. 23*g* shows an end view of the latch assembly of FIG. 23*a;*
Figure 24A:
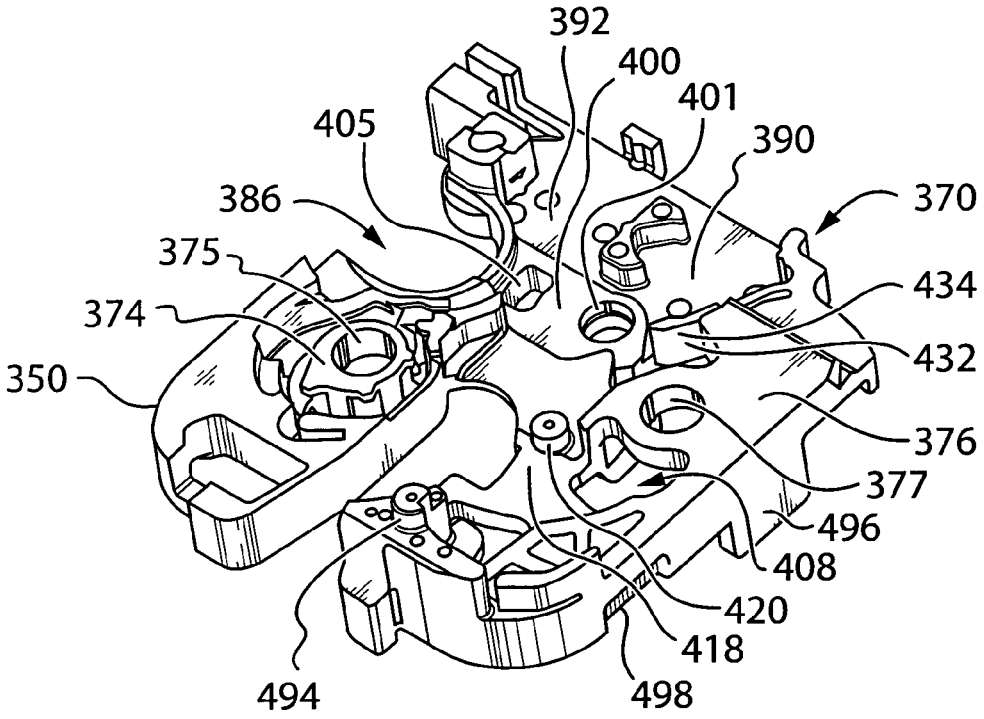
FIG. 24*a* is a top isometric view of a latch core housing common to the latch cores of FIG. 22*i* and FIG. 23*g;*
Figure 24B:
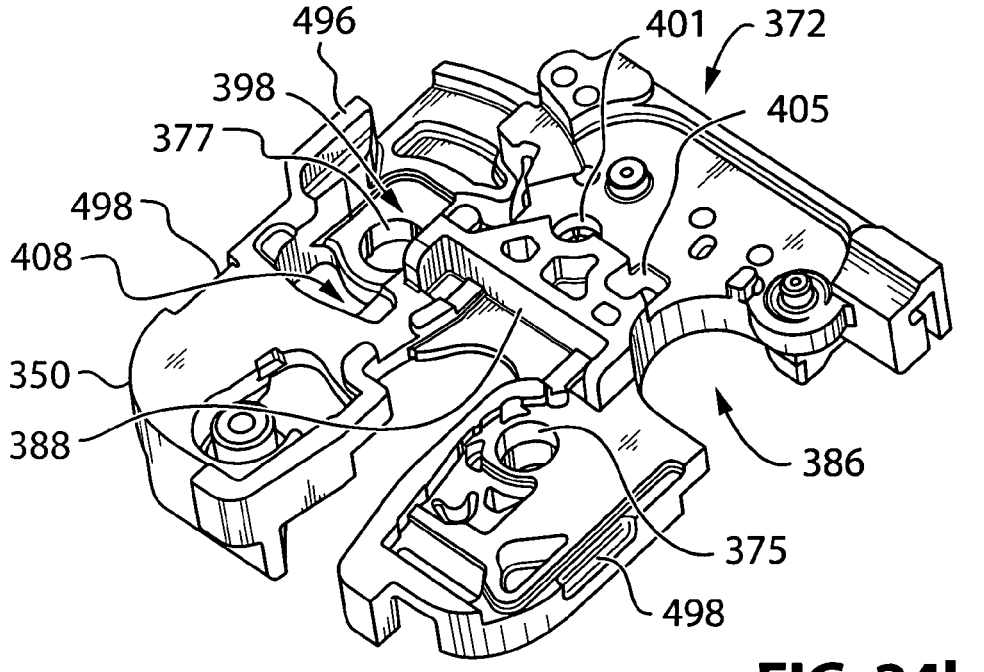
FIG. 24*b* is a bottom isometric view of a latch core housing common to the latch cores of FIG. 22*i* and FIG. 23*g;*

FIG. 21*c* shows compartment 86 on latch core 12, when the ratchet 30 moves to reset the snowload. This occurs when the decklid (or other closure panel) is manually opened. The manual door (not shown) opening pulls the striker out of the fish mouth 34, which rotates ratchet 30 to the released position. The rotation of the ratchet moves the four-bar assembly. A cam arm 278 on cinch axle 216 engages release arm 272, thereby pivoting snow load lever 264 in the direction of releasing hook 270 from shoulder 276.

FIG. 21*d* shows compartment 86 on latch core 12, pawl 32 returns to its normal resting position. With snow load lever 264 out of the way, secondary pawl 60 is free to return to its resting position, moving pawl 32 back to its resting position.

FIGS. 22*a*-22*i* show an alternate embodiment of latch or latch assembly, indicated generally as 300. Latch 300 may be an automobile latch suitable for use in cars and trucks, as may be. As with latch 10, latch 300 in effect designates not merely a single latch, but rather a latch assembly system, in which a relatively small number of common major components can be assembled to yield a series of different products such as those of the matrix of FIG. 2. For example, in one embodiment, the latch may include only a manual operation feature. In another embodiment the latch may include both power and manual release. It may include power locking and unlocking. It may include power cinching.

In each instance there is a latch core, 320 sandwiched between a first external enclosure member, or casing, or shell, or cover, such as may be identified in the illustrations as housing 322, and a second external enclosure member, which may have the form of an opposed backing wall, or plate, or cover, and is identified as wall member 324. It may be that wall member 324 serves not only as an enclosure, but also as an adapter or base plate 326 having fittings, sockets, seats or accommodations to which other modules may mount according to the functional requirements of the overall latch assembly. While the various base plates may have portions having overlapping common functionality and morphology (i.e., layout), they may also differ according to the seats or accommodations required.

There is a latch core envelope 330 between the members that define the external enclosure of the latch, be it 10 or 300. Envelope 330 exists whether the latch is to be used for a trunk, a gate, a lid, or a sliding door. Latch core 320 has a size and shape for containment within an envelope suitable for mounting (a) to a multiplicity of different brands of automobiles; and (b) to a multiplicity of configurations. That is to say, core 320 (and, for that matter, core 10, may fit within the intersection set of latch core envelopes for gate, door, and sliding door applications for a multiplicity of brands of automobiles, such that the same latch core components may be supplied to different manufacturers and different models of cars and trucks, and different applications in those models.

In the examples of FIGS. 22*a*-22*i*, housing 322 may be termed a basket, and may have the form of a stamped or drawn metal cup 332, with a attachment fittings, such as an array of fastening apertures 333, formed in a seating array, or footing, which may have the form of an array of tabs or tangs, or may have the form of a peripherally extending flange 334, which may be substantially planar or have substantially planar portions that present a flat surface, or surfaces, for mating engagement with the interior of an automobile door, lid or gate member, as may be. In the case of flange 334, the under surface 335 may seat against the mounting surface in the vehicle. Housing 332 will in general have a depending peripheral or partially peripheral wall 336, and a bottom, or base wall, or base wall portion 338. Peripheral wall 336 may extend perpendicular to flange 334, and, when mounted, protrude through the mounting surface of the vehicle. The projected footprint of depending cover peripheral wall 336 fits within a cover envelope, or outline, that is approximately 60 to 65 mm wide×60 to 65 mm long (with radiused corners) in the plane of flange 334. One embodiment is about 62 mm×62 mm. It follows that latch core 320 fits within this footprint, less the thickness of wall 336, leaving a projected latch core footprint of about, or slightly less than, 55 mm to 60 mm×55 mm to 60 mm (with radiused corners), and in one embodiment 57 to 58 mm×57 to 58 mm for all portions of latch core 320 that lie shy of the plane of the upper surface 337 of flange 334. It may therefore be said that the projected footprint of the depending portion of the cover i.e., housing 332, is less than 70 mm×70 mm, and the projected latch core footprint of those portions "submerged", or shy, of the plane of surface 337 is less than 65 mm×65 mm, with appropriate allowance for corner radii as may be. Housing 332 will in general have a cut-out or accommodation or relief 340 formed in an end-wall or sidewall portion of depending wall 336. Relief 340 may extend some distance into base wall portion 338, and may have the form of a blind-ended inwardly narrowing slot, generally having the shape of a fishmouth, relief being 340 of a size and shape suitable for admitting a door or gate striker, such as item 35 of FIG. 9, and such anti-noise or wear, or shock absorbing member or members as may be installed therein.

For the purpose of this discussion, the latch core envelope will be considered to be the volume that is (a) inside housing 332 as if relief 340 had not been made, but that peripheral wall 336 and base wall portion 338 were formed on continuous tangents or planes, or smooth curve conforming to their general shape; and (b) inside base plate 326. Also for the purposes of this discussion, it may be noted that various shaft or rivet ends, fastening tangs or tabs or clips of latch core 320, may extend outside this envelope, particularly to the extent that those features define attachment or location fittings by which latch core 320 is mounted to the cover, namely housing 332. However, in addition to fitting through the projected footprint outline noted above, latch core 320 also fits within an envelope, or envelope criterion, as discussed below.

An envelope 330 may include a first portion 342 and a second portion 344. First portion 342 may be termed the "bifurcated portion", and is defined by a width $W_{342}$, measured in the y-direction; a through-thickness $H_{342}$, measured in the z-direction; and a length, $L_{342}$ measured in the x-direction. It may be noted that the x-y plane in this reference co-ordinate system is oblique relative to the plane of flange surface 337. The angle of inclination may be in the range of 20 to 40 degrees, and, in one embodiment may be about 30 degrees. A closed position striker axis $C_{346}$ is defined as an axis running perpendicular to base wall portion 338 at the center of curvature of the major radiused portion of the cul-de-sac end 346 of relief 340. This approximates the centerline of the striker when the latch is fully closed, and, if there is no end radius of curvature from which $C_{346}$ may be determined then $C_{346}$ should be taken as the design centerline of striker 35 in the closed position. $L_{342}$ is defined as the length between axis $C_{346}$ and the plane of the inside endwall portion of depending peripheral wall 336. In one embodiment $L_{342}$ is less than 32 mm, and, in another embodiment is between 25 and 32 mm, and, in still another embodiment is between about 28 and 30 mm. Including the wall thickness of the endwall portion of depending wall 336, the overall lengths may be less than 35 mm in the first instance, between 30 and 35 mm in the second instance, and between 30 and 32 mm in the third instance. $L_{342}$ may be termed the fishmouth travel length. $W_{342}$ may be taken as the inside width between the major or predominant substantially parallel and substantially planar portions of the sidewall portion 338, and, if there is no such predominant portion, then the general wall width spacing taken in the plane normal to $L_{342}$ that intersect $C_{346}$. This dimension may be less than 65 mm or 70 mm, and, in some embodiments may be about, or less than 60 mm. $H_{342}$ is the predominant through thickness clearance dimension between base wall portion 338 and wall member 324 in the region between $C_{346}$ and the open end of the fishmouth. This dimension does not include protruding asperities such as rivet heads, attachment tangs or tabs, or the ends of shaft or pivot members that seat in either member 322 or member 324. Conceptually $H_{342}$ defines the through thickness of the zone in which moving internal parts in the lower two layers of latch core 320 may swing or rotate. As may be appreciated, the envelope could also be defined in terms of the outside dimensions of the cover 322, and the position of its flange 334.

As seen in FIGS. 24*a* to 24*e*, one embodiment of latch core 320 may include a primary member, or base plate, or frame, or chassis, or carriage, or spider, or carrier, or platform, or substrate, or skeleton, or matrix member identified herein as a housing 350. However it may be called, housing 350 provides a common dimensional datum member, or common frame of reference, for the location of the other members of latch core 320. To that extent, housing 350 may be a monolithic casting, or molding, and may be made of a polymer, such as an high density plastic. The following latch core members of note are mounted to housing 320: a ratchet, 352 and ratchet biasing member in the nature of a ratchet return spring 353 that biases ratchet 352 to the open or release condition, and a ratchet axle, identified as ratchet rivet 354 upon which ratchet 352 pivotally mounts; a pawl 356 and an axle identified as pawl rivet 355; a secondary pawl 358 and pawl biasing member in the nature of a pawl return spring 359; a position sensor switch identified as primary switch 360; a first status sensor member identified as striker primary switch lever 361; a second latch status sensor member identified as striker secondary switch lever 362 and a switch lever rivet 363; an overslam bumper 364; a switch lever biasing member in the nature of a spring 365 that biases both lever 361 and lever 362; and a snowload lever 366, and its associated return spring 367. As with latch core 10, these various components may be designed to avoid unintended inertial moments about their fulcra and so may tend to avoid unintended release.

Housing 350 has a first face or side 370 and a second face or side 372. First side 370 will arbitrarily be designated as the down side, and, as installed, faces toward base wall portion 338. By contrast, second side 372 will be designated as the up side, and, as installed faces away from base wall portion 338. Considering also the isometric views of FIGS. 24*a* and 24*b*, ratchet 352 seats underneath first side 370, i.e., between housing 350 and base wall portion 338, with the ratchet pivot pin, rivet 354, passing through the bored boss 375 of the accommodation identified as ratchet seat 374. In this position ratchet 352 can pivot through the full range of motion between the positions identified in FIGS. 25*a*, 25*b*, 25*c* and 25*d*. Similarly there is a pawl seat, or boss, or accommodation 376 with associated bore 377 for its pivot pin, namely rivet 357. Pawl 356 is pivotally mounted on rivet 357 below housing 350, and secondary pawl 358 is mounted on rivet 357 above housing 350, with the depending lug, or force transfer arm 412 of secondary pawl 358 extending in the z-direction through the clearance allowance slot 378 such that secondary pawl 358 can bias pawl 356 in operation. The respective return spring biases pawl 356 to the engaged position for preventing release of ratchet 352. As may be noted, pawl 356 has the form of a hook, with a tooth 380 that engages either the first stop or abutment 381 of first arm 382 of ratchet 352, or the second stop or abutment 383 of second arm 384 of ratchet 352, as may be. In this embodiment the cinch drive accommodation 386 is empty. Overslam bumper 364 is installed between the back coverplate 324 and abutment wall 388 at the inner end of the fishmouth.

The underside of housing 350 also has an array of fittings, or accommodations, or mountings that include primary (or pawl) and secondary (or striker) switch seats, 390, 392, into which a primary (or pawl) switch 360 and secondary (or striker) switch 394, respectively, may seat. A manually operated latch assembly, such as that version of latch core 320 shown in FIG. 24*a* may have only a primary switch. The state of switches 360 and 394 (either 'ON' or 'OFF') is determined by the positions of the striker position sensor, namely striker primary switch lever 361 and striker secondary switch lever 362, and of an arm of secondary pawl 358. These switch levers are, in effect, signal transmitting members that transport a mechanical signal, in the form of a physical deflection of an input arm, from the location at which the signal is sensed, (i.e., the position of pawl 356, or the position of a striker 35 in the fishmouth, as may be), to the input of the respective switch.

The main body of secondary pawl 358 occupies an accommodation 398 sunken into the top side of housing 350. Secondary pawl 358 is mounted on a common axis in the primary pawl 356, the two being located on either side of housing 350. Depending foot 412 of secondary pawl 358 extends through motion clearance part 408 in housing 350 to seat within socket 378 of pawl 356. Secondary pawl 358 also has an actuation input in the form of a lug 410 that protrudes upwardly from cover 324 for connection with such release input signal device or actuator as may be employed. Lug 410 may be located at the far end of secondary pawl 358 distant from foot 412. Between lug 410 and its pivot shaft or pin (i.e., rivet 355) secondary pawl 358 may have a primary switch contact member in the nature of an extending wing, or cam, or arm, identified as a horn 409. As installed in the illustrated embodiments, horn 409 extends, and travels, in a plane beneath the plane of snowload lever 366. In this context, pawl 358 may itself have the function of a latch status sensor member since the position of secondary pawl 358 is a signal of the position of pawl 356, and hence of one element of the status of the latch.

Housing 350 also has a fitting, seat, mounting or accommodation 418 for striker primary switch lever 361, that accommodation including a boss 420 onto which a mating socket of striker primary switch lever 361 seats, thus defining a pivoting connection. Striker primary switch lever 361 has three arms extending away from the central socket. The first arm 414 of lever 361 may be considered the output arm, and is pivotally biased by spring 363 to bear away from primary switch 360. The second arm, 416, is similarly biased to protrude into the inner end of the fishmouth, and to be displaced therefrom when the striker occupies its fully cinched position. The third arm may be a counterweight arm.

Housing 350 includes an accommodation, or fitting, or mounting, or seat, for striker secondary switch lever 362, in the form of a land 400 having a bore 401 into which a pivot axle or shaft in the form of a switch lever rivet 363 is mounted. There is an adjacent opening 405 that accommodates a motion transfer lug 404 of lever 362 that interacts with snowload lever 366. Spring 363 biases major arm 422 to a default position in which it obstructs the fishmouth. I.e., introduction of a striker 35 into the fishmouth deflects arm 422 (the leading edge of arm 422 acting as a cam surface, in effect). This causes the second arm 430 of the lever to move, and, ultimately, to cause a change of state of second switch 394. Thus lever 362, functions as a status sensor member with respect to the position of the striker, and provides output to (a) the secondary switch 394; and (b) the snowload lever 366, for which it acts as a reset arm.

Inasmuch as there may be a potential tolerance mis-match between arm 430 and the contact of switch 394, housing 350 includes an integrally formed movable partition member 432. Member 432 may have the form of a molded or living spring. The molded spring may have a relatively broad end, or paddle 434 located between switch 360 and horn 409 of secondary pawl 358; and also between switch 360 and arm 414 of striker primary switch lever 361. The paddle provides a relatively large target front or first surface, or land, against which horn 409, or arm 414, or both, can act, and is sufficiently torsionally stiff that member 432 has effectively a single degree of freedom—namely deflection in the direction of action of switch 360. The second, or back surface of paddle 434 acts against switch 360. Partition member 432 may have an at rest position clear of switch 360, and so is spring loaded when deflected, and therefore has a default bias away from switch 360.

The logic of operation of switch 360 is thus that disengagement of pawl 356 in response to either (a) inward cinching motion of either of the ratchet toes against the cam surface defined by the back face of tooth 380; or (b) a release input deflection of lug 410 (such that hook 380 of pawl 356 is clear of the path of the stop, or finger, or abutment 381 of the first arm 382 of ratchet 352, and clear of the path of abutment 383 of the second arm 384 of ratchet 352, thereby permitting the ratchet to be driven to its open position, releasing the striker), will cause a mechanical input signal to be transmitted as horn 409 to pushes against member 432, depressing the contact of switch 360. Alternatively, the default bias of striker primary switch lever 361 will cause arm 414 to depress the contact of switch 360. To obtain a change of state from this condition, namely to have arm 432 spring away from switch 360, both contact inputs must be removed. That is, for switch 360 to change from the 'On' (a) lever arm 416 of a striker secondary switch lever 361 must be displaced by a striker, and pawl 356 must be in the engaged (i.e., passive or inactive default condition under its default biasing spring). The practical effect of this logic is that switch 360 will not have a temporary bump (such as might otherwise shut off a cinch drive motor) when the ratchet teeth bump past hook 380 during cinching to a closed position; and in the event that there is a tip-on-tip engagement of hook 380 with one or the one or the other of the ratchet teeth, the mechanism will tend not, erroneously, to infer that cinching is complete, but rather to continue driving until lever arm 416 is displaced. This is possible, in part, by having both the primary and secondary striker switches (a) have ranges of motion that overlap (and, in default obstruct) the fishmouth, whence they can be displaced on introduction of the striker; and (b) by making the levers thin and overlapping in the z direction to share a single accommodation layer by locally occupying only half of that layer. Member 432 thus becomes a summing bar, or a logical AND in the away direction, or a logical OR in the toward direction. In the release mode, an electrical controller may count the time interval following a release signal being given, and if it exceeds a threshold value without a change of state at switch 360, such as half a second or a second, may infer that something is preventing the latch from opening, or that there is a fault.

Further, there are two striker status sensors. The primary sensor monitors whether the striker has reached the end of its range of travel and is seated in the fully cinched, or closed position at the inner end of the fishmouth. The other sensor changes state when the striker is near or at the beginning of its range of motion along the fishmouth moving inwardly (or at the end of its range of motion, moving outwardly). This may occur at the same time, or about the same time that ratchet 352 reaches the secondary position (i.e., toe 381 is rotationally inside the grasp of hook 380). Expressed differently, member 362 is used to sense the presence of the striker in the fishmouth slot along substantially its entire range of motion between the secondary position or condition, and the fully cinched or closed position or condition. Member 361 uses a different portion of the range of motion of the striker—namely the fully cinched, or closed, or primary, position only. Thus the change of state of switch 394 on release effectively signals that the striker has passed, or is passing, the secondary position on its way to the fully released position.

FIGS. 23*a*-23*g* show a latching assembly 450 that includes a version of latch assembly 320 having a release input, as at 452, and a power cinching input, as at 454. This mechanism includes an externally accessible input interface, in the nature of a crank or crank assembly 456 that is accessible from inside the vehicle—i.e., from above the plane of flange 337. Crank 456 may be driven by pulling on a cable 458. Crank 456 includes a pivot member, or axle, or shaft 460 that extends into the latch body, and which may be termed a rivet, notwithstanding its function as a driven torsion rod or shaft. This shaft is perpendicular to the planes of swinging motion of the ratchet and pawl. A return spring 462 biases crank 456 to the inactive, or disengaged, state. The bottom, or inner end of crank 456 includes an output lug 464. In contrast to the four bar linkage described above, the cinching mechanism includes a connecting link, in the form of a push rod is identified as finger 466. While pinned at one end to lug 464, the other, far or distal end 468 is not pinned to ratchet 352. Ratchet 352 has a mating interface, or female socket, or accommodation identified as horn 470, for receiving, and engaging, end 468. This is a uni-directional force transfer interface: end 468 can exert a push across this interface, but cannot exert a pull. Thus there is a drive train, or force-transmission path, from the cinching input to ratchet 352. The crank assembly passes in the z-direction clear through the accommodation or relief 386 formed in the carrier, housing 352. The positions of the ends of crank assembly are fixed in the x and y directions by locating holes in the cover plate and in the backing plate, i.e., members 322 and 472, and the position in the z-direction is established by the height at which lug 464 is fixed on shaft 460. The cinching mechanism is activated when a striker is detected in the fishmouth (with the corresponding change in state of secondary switch 394, and the logic of the position indicates that the latch is moving from an open to a closed condition.

Another feature of the core body is a pawl release signal sustainer, more commonly referred to as a snow load lever 366. As before, housing 350 includes a snowload lever accommodation, 480, in this case between housing 350 and the upper, or back plate member 324 or 472 (as may be) that includes a seat, or fitting or mount identified as boss 484. Boss 484 mates with a corresponding bore of snow load lever 366, so defining a pivoting connection. When the release mechanism is actuated, as, for example, by pulling lug 486 of secondary pawl 356, the default spring bias of snow load lever 366 causes its first end 488 to rotate to block the return motion of the release actuator. When, however, the state of the striker switch lever pivots on release motion of the striker, its upstanding lug bears against the second end 490 of lever 366, returning it to its normal, passive, disengaged position, and the release actuator returns to its home, or inactivated, position. This prevents reset of the secondary pawl unless the door (e.g., a trunk lid) has actually moved. The presence of the snowload lever, may be associated with the formation of an upward step in the top or back cover plate, 324, as at 482, immediately inboard of the overslam bumper.

The body of member 350 has a number of other features. First, it has downwardly protruding locating boss 494 by which the x and y location of member 350 is fixed relative to the cover, housing 322. It also has indexing features, such as an upstanding tang or abutment wall 496 and keying rebates 498 by which the x and y location of backing plate member 324 is fixed relative to member 350. Further, as may be noted member 350 has the bifurcation, generally indicated at 500 that defines the wide-mouthed, progressively tapering fishmouth accommodation for striker 35. Member 350 includes a striker, or wear surface, or wear surface portion, or portions, in the thickened inlet wall portions 502, 504 that define the inlet guideway. Inasmuch as member 350 may be made of an high density plastic, wall portions 502, 504 may contribute to a lessening of latch noise. The inward end of the fishmouth is generally rounded, as at 506 in a manner generally corresponding to that of the cover, namely member 322. By their nature, portions 502 and 504 are intended to stand proud of all other structure, so that they are encountered by the striker in preference to any other structure, and so protrude from, or be roughly flush with, the cover, i.e., member 322 in both the x-direction as at the open end of the fishmouth, and in the z-direction, where they overlap the cut edges of the cover plate. To that extent, these portions extend beyond the footprint, or envelope of the latch core proper. That envelope is defined by peripheral side wall portions 510, 512, and by peripheral end wall portions 514, 516 as if a continuous tangent plane, P, extended between them.

Figure 25A:
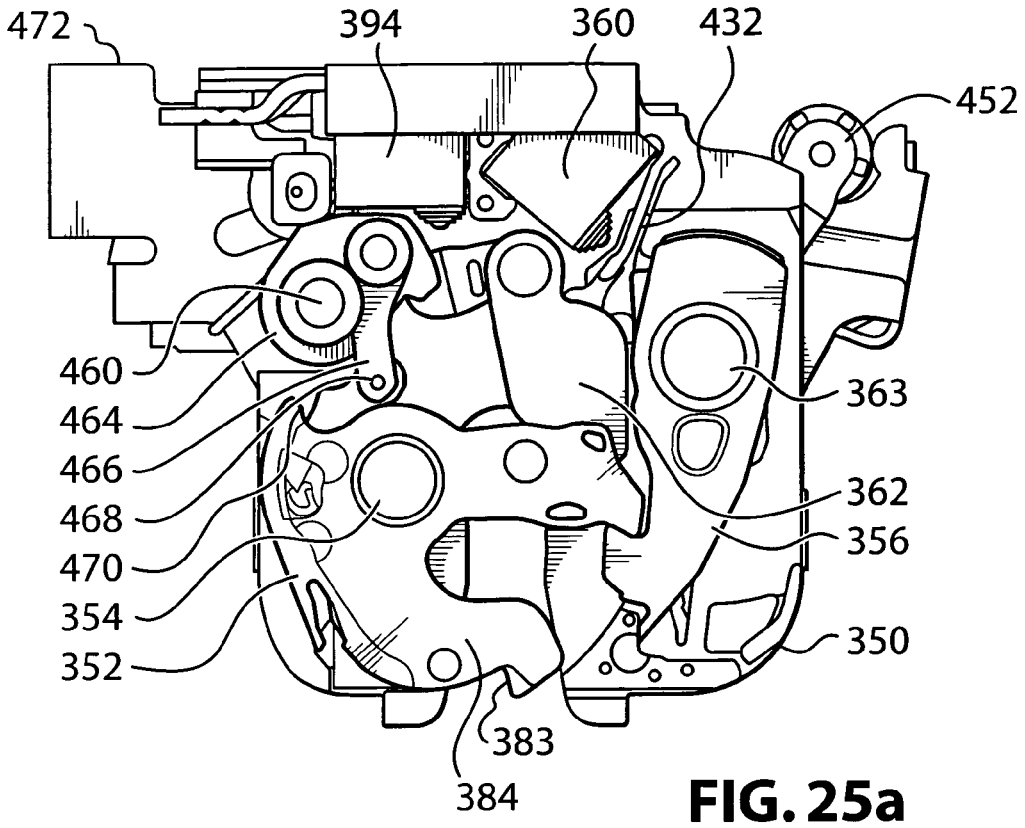
FIG. 25*a* shows the latch core of FIG. 24*a* in a "secondary" position at the initiation of power cinching.
Figure 25B:
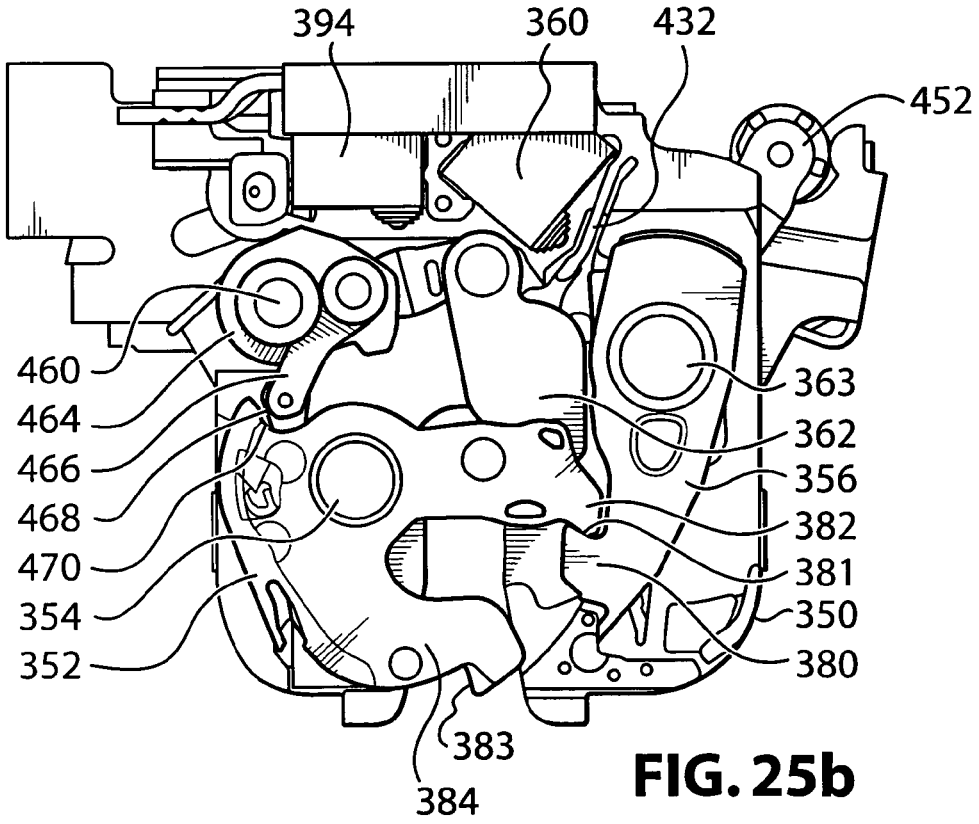
FIG. 25*b* shows the latch core of FIG. 25*a* in a first cinching position.
Figure 25C:
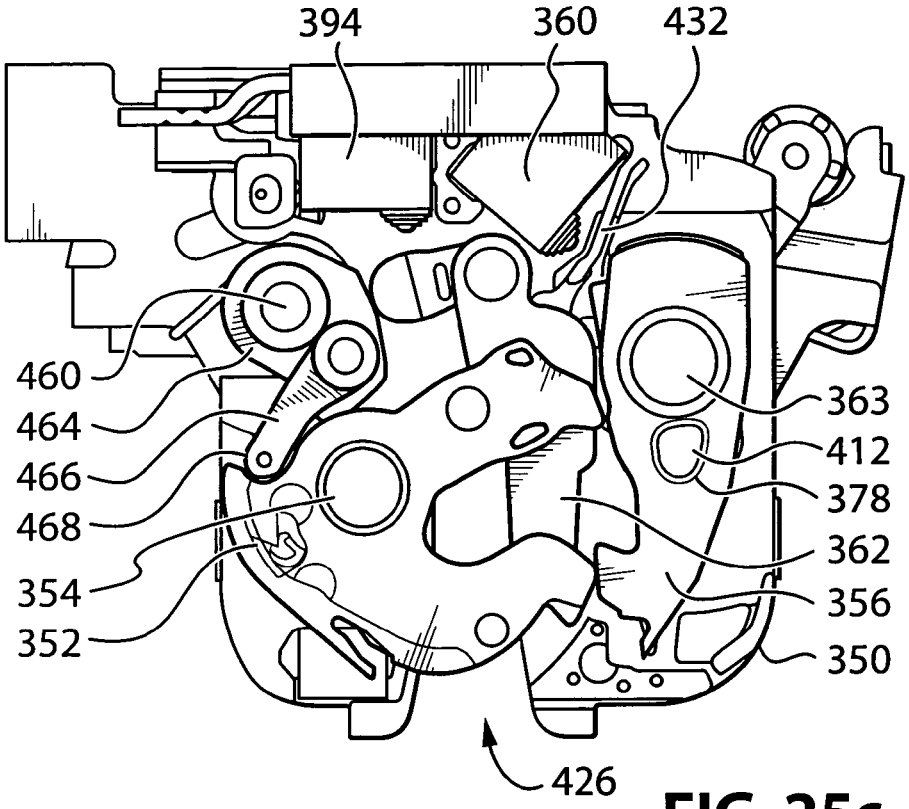
FIG. 25*c* shows the latch core of FIG. 25*a* in a second cinching position.
Figure 25D:
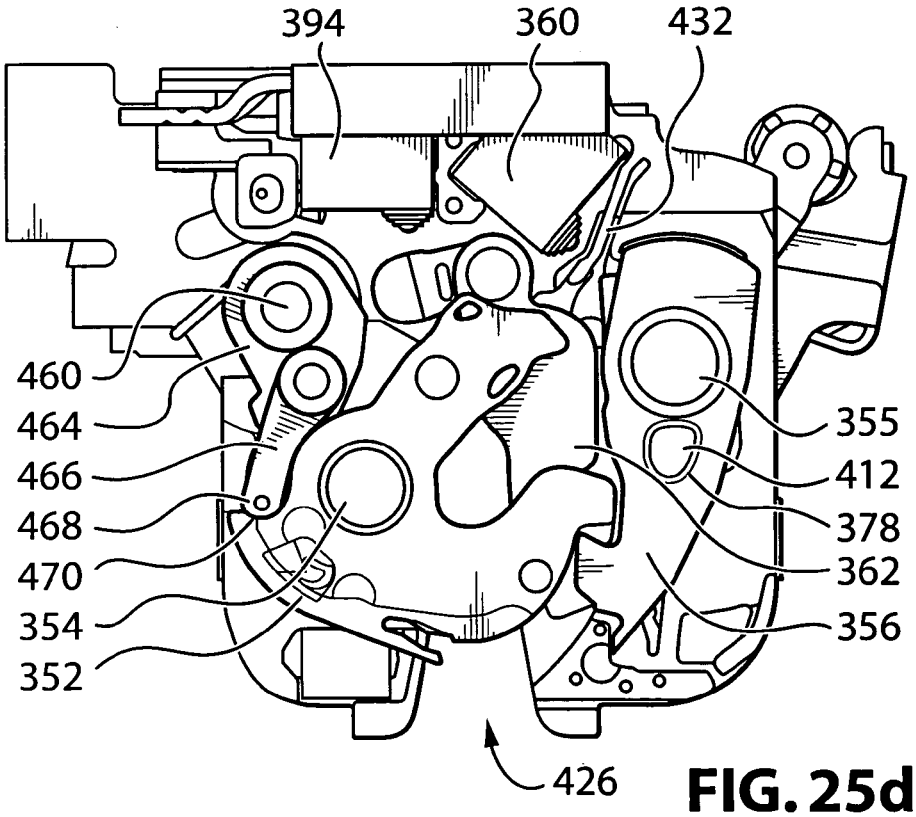
FIG. 25*d* shows the latch core of FIG. 25*a* in a fully cinched position.

FIGS. 25*a*-25*d* show a progression of steps in closing. FIG. 25*a* shows the position reached by latch core 320 when a striker has entered the claw, i.e., ratchet 352, and the first toe has move within the hook tip of pawl 356. The striker detection member, namely secondary switch lever 362, has been deflected, and secondary switch 394 is in a state indicating the presence of the striker. Power clinching commences, causing push rod 466 to advance to reach the stage shown in FIG. 25*b*, in which the push rod 466 is engaged in horn 470 at the rear end of ratchet 352. Cinching continues, with push rod 466 driving the ratchet counterclockwise to the position in FIG. 25*c*, in which second toe 384 of ratchet 352 rides up on the back of hook 380 of pawl 356, tending to force pawl 356 to rotate counterclockwise outward. As second toe 384 of ratchet 352 clears hook of pawl 356, pawl 356 springs back into its engaged (or default) position relative to abutment 383, once again changing the state at primary switch 360, such as may indicate that second toe 384 is entrapped, and striker 35 is in its fully cinched position. In this condition, the cinching motor is commanded to stop in the fully clinched condition of FIG. 26*d*. The motor is then reversed and run to it "home" position.

This is seen in the logic of FIGS. 26*a* and 26*b*. That is, the cinching cycle is assumed to start from a condition in which the latch core is in the open or release condition, with the ratchet turned fully clockwise to accept an incoming striker. The striker is pushed forward until the ratchet reaches the position indicated in FIG. 25*a*. At this point the secondary switch opens, and a signal is sent to operate the clinching motion. The outward bump of the pawl in FIG. 25*b* changes the state of the primary switch, i.e., to a closed condition. This does not affect operation of the cinch motor. The return change of state of the primary switch, from closed to open, however, provides the signal to the controller to stop the cinch motor, and then to drive it in the opposite direction to its "home" condition in which the lug and link of the cinch drive return to the position shown in FIG. 25*a*.

The release cycle is shown in FIG. 26*b*. At some point an handle switch is triggered, be it manually, or electronically. Provided that the door is neither locked, nor subject to a child lock override, ultimately the release lever is tugged to move secondary pawl lever 358, and hence to disengaged pawl 356. For power release, the motor drives the cable pulling lever 358. As soon as pawl switch 360 is released, the snow load lever engages under its default spring bias to prevent retraction of pawl lever 358. Either (a) the operation of the motors and the default biasing of the ratchet spring causes rotation of ratchet 352 to release striker 35, or, if there is snow or some other force holding the door or lid or gate closed, the operator manually opens the gate, then the state of the striker status monitoring sensor changes, as indicated by a change of state at switch 394. For latch module 10, the cinching motor runs to the open or released condition, for latch 320, the motor may already be in its home position. If the controller times out before this signal occurs, then the cinch motor is powered to re-cinch the striker, and, in so doing, to reset snowload lever 366. This may also tend to reset the pawl switch, and the cycle is ready to restart.

In this description, reference is made to a change of state of the switches. It is in large measure arbitrary whether a switch is nominally "ON" or nominally "OFF" for the logic of operation of the latches described above to apply. It is perhaps more to the point to indicate that operation of the various releases, locks, drives, and mechanisms depends on the switches having a first state and a second state, and that the system is responsive to changes of state of the switches, as described. The first switch state may be 'ON' and the second switch state may be 'OFF' in some embodiments, and the reverse in others, without changing the underlying logic.

The latch core, be it 12 or 320, is thus mounted between an outside enclosure member e.g., 322, and an inside backing plate e.g., cover 324, in a mechanical sandwich having a fishmouth for admitting a matably engageable striker 35. The latch core has a substrate, namely housing 350; a ratchet 352 and ratchet biasing member; a pawl 356 and pawl biasing member; and a first status sensor member and an associated first status sensor switch, namely either the pawl sensor lever 361 or the striker status sensor lever 362. The substrate has accommodations for the ratchet, the ratchet biasing member, the pawl and the pawl biasing member, and for the first status sensor member and the first status sensor switch. The core may include a second latch core status sensor member (i.e., it has both 361 and 362), and an associated second latch core status switch, for which the substrate has accommodations. The striker status sensor member, 362, moves independently of both ratchet 352 and pawl 356. The striker position or status sensor member, 362, has a default bias toward obstructing said fishmouth. The ratchet and the pawl are pivotally movable in a shared layer. The sensor members are mounted in, and are movable in, a different layer. The ratchet and the striker status sensor have overlapping projected ranges of motion when seen normal to said layers. The substrate, namely housing 350, has a first set of fittings constraining motion of said ratchet and said pawl to a first layer; and has a second set of fittings constraining motion of the status sensor members to an adjacent layer. The first set of fittings includes a first substantially planar wall. The second set of fittings include a second substantially planar wall parallel to and offset from said first substantially planar wall. The status sensor members and the switches are mounted in said second layer. The substrate may also define a third layer. The third layer has a release signal maintaining member mounted therein, namely the snowload lever. The substrate may also have mechanical signal transmission passages formed therethrough, such as items 386, 405 and 408. The substrate is formed of a molded monolith, which may be plastic or metal.

The substrate may include and an integrally formed movable member interposed between the accommodation for the first status sensor switch and the first status sensor member. The movable member may be positioned to be acted upon by the first status sensor member. The movable member may be positioned to act upon the first status sensor switch when acted upon by the first status sensor member. The movable member may be wider than one or the other or both of the status sensor and the switch, and so may allow for any dimensional tolerance mismatch between them. The movable member may have the form of a living spring. It may be resiliently biased to a default position clear of said first switch. The substrate has a switch accommodation depth, and the movable member is constrained to deflect in a first degree of freedom in a direction cross-wise to that depth. The width corresponds substantially to the accommodation depth.

Further the substrate is formed of a molded monolith having a striker motion accommodating slot defined therein, namely the fishmouth. The first status sensor member, lever 362, is operable to sweep through a range of motion. The range of motion overlaps at least part of the striker motion accommodating slot. The ratchet and the first status sensor member are each mounted to pivot in a respective plane. The ratchet and the first status sensor member are not co-planar. The ratchet and the first status sensor member sweep out respective ranges of motion that are overlapping, and can sweep past each other. The substrate also includes fittings defining accommodations for a second status sensing member, namely lever 361, and a cooperable second status sensing member switch, namely switch 360, those accommodations being in a layer other than the first layer.

In summary, the latch core, be it item 320 or item 12, includes a matrix member that provides a locational datum, or frame of reference for the various moving members of the latch core (e.g., the ratchet, the primary and secondary pawl, the switch lever, or levers, and the switch, or switches. It may also provides a frame of reference for the snowload lever, if there is one, assembly, and either directly or indirectly provides a datum for the cinch mechanism, if there is one. The latch core is divided into layers, or levels. The matrix member may also define a geometric relationship of the parts such that the resulting assembly falls within a particular space envelope, such as a common denominator envelope between a range of latch types and uses.

In one layer, which may be the first or bottom layer, are the ratchet and pawl. In another layer, which may be a second layer, is the secondary switch lever, which detects the presence of a striker in the fishmouth. The primary switch lever may also be mounted to operate in the second layer, although it could, alternatively be mounted to operate in the first layer. The striker switch detection lever operates in a different layer, or plane from the ratchet. It pivots independently of the ratchet, and swings through a motion envelope that overlaps the motion envelope swept by the ratchet. To the extent that separate plane are defined for each layer, they may be defined as the planes of the center of these elements. The switches are in the planes, or layers of the respective switch levers. The snowload lever is in yet a third plane, or layer. To achieve this, member 350 has, in effect, a first level, or plateau or shelf, or array of surfaces that is parallel to the plane of motion of the ratchet and pawl.

This array of surfaces may include co-planar surfaces, and may include the ratchet boss and neighbouring land of one side or leg of the bifurcation; and pawl shelf of the other side or leg of the bifurcation. Member 350 also has a second shelf, or layer or array of surfaces, which may be recessed (or shy of) the surfaces of the first shelf or layer, and may include a recess and surface for the primary switch lever, and a recess or region and surface for the secondary switch lever, and surfaces, or regions on substantially the same plane on which the primary and secondary switches may mount. The switch levers and switches do not need to be mounted in the same plane as each other, and, the switch levers, or portions of them, may overlap and undergo movement with respect to each other about their respective pivots. Member 350 may also have a third shelf, or surface or array of surfaces such as may accommodate the parallel planar pivoting motion of secondary pawl 358, and a fourth surface, or array of surfaces such as may defined the location of the snow load lever. The matrix member may include appropriate pivot or fulcrum fittings, whether bores for shafts or bosses for sockets, for these various moving members, and may include motion or signal (or both) transmission passages between the various layers, whether those passages or openings allow for lost motion or not.

An latch function adapter plate, such as may be termed a brain plate, may be mounted to latch 300 in much the same manner as to latch 10. The choice of adapter plate will be determined by the desired function or functions and the cinching, locking, or other modules to be combined with it for a particular application as described above. In that context, the latch may be seen as a device having two input ports or signal receiving devices, those being the release and the cinch drive input; and two output or monitoring signals, those being the two switch states. In this circumstance, there may be more than two switch input sensor members, and it may be that none of the input sensor members is directly connected to, or directly monitors, ratchet position or operation.

The principles of the present invention are not limited to these specific examples which are given by way of illustration. It is possible to make other embodiments that employ the principles of the invention and that fall within its spirit and scope of the invention. Since changes in and or additions to the above-described embodiments may be made without departing from the nature, spirit or scope of the invention, the invention is not to be limited to those details.

We claim:

1. A latch for an automobile, the latch having a housing having a slot for receiving a striker, the latch comprising:

a co-operating ratchet and pawl pair mounted to the housing;

a first striker sensor mounted to the housing about a first pivot axis to monitor the presence of a striker in an entrance portion of the slot;

a second striker sensor mounted to the housing about a second pivot axis and positioned to monitor the presence of the striker in a fully closed position at an inner end of the slot;

a pawl position sensor to monitor the position of the pawl when in an engaged position;

a primary switch whose state is changed in response to a combination of both a first indication by the second striker sensor of the striker being in the fully closed position and a second indication by the pawl position sensor of the pawl being in engagement with the ratchet;

an actuator operable to drive the ratchet to cinch the striker in response to indication from the first striker sensor that the striker is present in the entrance portion of the slot and to stop cinching of the striker in response to said state is changed of the primary switch, and a secondary switch whose state is changed by movement of the first striker sensor by the striker in the entrance portion of the slot in order to said drive the ratchet.

2. A latch as claimed in claim 1, further comprising: a secondary switch whose state is changed by movement of the first striker sensor by the striker in the entrance portion of the slot in order to said drive the ratchet.

3. A latch as claimed in claim 1, wherein the second striker sensor includes a lever that is movable away from the primary switch by the presence of the striker at the fully closed position.

* * * * *